US009398941B2

(12) United States Patent
Simmet

(10) Patent No.: US 9,398,941 B2
(45) Date of Patent: Jul. 26, 2016

(54) MULTI-COMPARTMENT CONTAINER FOR BIOLOGICAL LIQUIDS

(71) Applicant: Minitube of America, Inc., Verona, WI (US)

(72) Inventor: Ludwig O. Simmet, Verona, WI (US)

(73) Assignee: MOFA Group LLC, Shawano, WI (US)

( * ) Notice: Subject to any disclaimer, the term of this patent is extended or adjusted under 35 U.S.C. 154(b) by 204 days.

(21) Appl. No.: 13/911,618

(22) Filed: Jun. 6, 2013

(65) Prior Publication Data

US 2013/0345497 A1 Dec. 26, 2013

Related U.S. Application Data

(60) Provisional application No. 61/656,465, filed on Jun. 6, 2012.

(51) Int. Cl.

| | |
|---|---|
| ***A61D 19/02*** | (2006.01) |
| ***B65D 81/32*** | (2006.01) |
| ***B01F 15/02*** | (2006.01) |
| *B01L 3/00* | (2006.01) |

(52) U.S. Cl.

CPC ..... *A61D 19/024* (2013.01); *A61D 19/022* (2013.01); *B01F 15/0213* (2013.01); *B01F 15/0215* (2013.01); *B65D 81/3266* (2013.01); *B01L 3/502* (2013.01)

(58) Field of Classification Search

CPC ..... A61D 19/00–10/04; B01F 15/0215; B65D 25/06–25/082; B65D 81/3211; B65D 25/085; B65D 25/087; A61B 17/425–17/435

See application file for complete search history.

(56) References Cited

U.S. PATENT DOCUMENTS

| | | | | |
|---|---|---|---|---|
| 611,520 | A * | 9/1898 | Smith | 206/221 |
| 5,006,117 | A | 4/1991 | Cassou | |
| 5,267,646 | A * | 12/1993 | Inoue et al. | 206/204 |
| 5,595,866 | A | 1/1997 | Critser et al. | |
| 5,853,388 | A * | 12/1998 | Semel | 604/82 |
| 5,961,503 | A | 10/1999 | Simmet et al. | |
| 6,028,057 | A | 2/2000 | Burns | |
| 6,054,287 | A | 4/2000 | Gao et al. | |
| 6,142,102 | A | 11/2000 | Mack et al. | |
| 6,399,363 | B1 | 6/2002 | Hammerstedt et al. | |
| 6,527,703 | B2 | 3/2003 | Simmet | |
| 6,551,819 | B1 * | 4/2003 | Simmet | 435/307.1 |
| 6,890,708 | B2 | 5/2005 | Matthijs-Rijsenbilt et al. | |
| 6,902,931 | B1 | 6/2005 | Toner et al. | |
| 7,445,590 | B2 | 11/2008 | Selle et al. | |
| 7,555,878 | B2 | 7/2009 | Brioschi | |
| 7,950,208 | B2 | 5/2011 | Mancin et al. | |

(Continued)

FOREIGN PATENT DOCUMENTS

| | | | |
|---|---|---|---|
| EP | 1 520 800 | A1 | 4/2005 |
| WO | 99/51509 | A1 | 10/1999 |
| WO | 01/85057 | A1 | 11/2001 |

OTHER PUBLICATIONS

Baracaldo, Mario; "Quality Control of Extended Boar Semen"; London Swine Conference—Facing the New Reality; Apr. 1-2, 2008; pp. 195-206.

(Continued)

*Primary Examiner* — Catherine B Kuhlman

(74) *Attorney, Agent, or Firm* — Whyte Hirschboeck Dudek S.C.

(57) ABSTRACT

A multiple chambered container for biological liquids useful in artificial insemination is disclosed.

32 Claims, 21 Drawing Sheets

(56) References Cited

U.S. PATENT DOCUMENTS

| | | | | |
|---|---|---|---|---|
| 8,017,553 | B2 | 9/2011 | Doane et al. | |
| 8,025,855 | B2 | 9/2011 | Kuhlow et al. | |
| 8,136,483 | B2 | 3/2012 | Anderson et al. | |
| 2007/0237431 | A1 | 10/2007 | Perell | |
| 2009/0107001 | A1* | 4/2009 | McCarthy | 34/284 |
| 2010/0025268 | A1* | 2/2010 | Lee | B65D 25/082 206/221 |
| 2011/0182530 | A1 | 7/2011 | Park | |
| 2012/0046519 | A1 | 2/2012 | Webel et al. | |
| 2012/0060574 | A1 | 3/2012 | Rose | |

OTHER PUBLICATIONS

Best, Ben; "Perfusion & Diffusion in Cryonics Protocol"; http://www.benbest.com/cryonics/protocol.html; retrieved from the internet Apr. 25, 2012; 29 pgs.
Chaudhari, S.U.R., et al.; "An Overview of Cryopreservation of Cattle and Buffalo Bull Semen"; International Journal of Agriculture & Biology; vol. 4, No. 4; 2002; pp. 572-575.
Dominiek, Maes, et al.; "Artificial Insemination in Pigs"; Artificial Insemination in Farm Animals; Jun. 2011; pp. 79-94.
Gadea, Joaquin; "Semen Extenders Used in the Artificial Insemination of Swine—A Review"; http://www.en.engormix.com/MA-pig-industry/genetic/articles/semen-extenders-used-artificial . . . ; retrieved from the internet Apr. 25, 2012; 9 pgs.
Hood, R.D., et al.; "Effects of Cold Shock, Diluation, Glycerol and Dimethyl Sulfoxide on Cation Concentrations in Porcine, Spermatozoa"; J. Anim. Sci.; 1970, 30:91-94.
Knox, Robert V.; "Semen Processing, Extending & Storage for Artificial Insemination in Swine"; Department of Animal Sciences, University of Illinois, 2011; 7 pgs.
Lemma, Alemayehu; "Effect of Cryopreservation on Sperm Quality and Fertility"; Artificial Insemination in Farm Animals; Jun. 2011; pp. 191-216.
Martinez, Emilio, et al.; "New Fresh-Semen Artificial Insemination Techniques in the Swine Species"; http://www.pig333.com/print/3433; Oct. 13, 2010; 2 pgs.
Maxell, W.M.C.; "Physiology of Spermatozoa at High Dilution Rates: The Influence of Seminal Plasma"; Theriogenology 52:1353-1362; 1999.
Oncken, John; "Verona Firm a Major Player in Swine A.i. Industry"; Capital Times: Business Today; Nov. 29, 1996; 2 pgs.
Strzezek, Rafal, et al.; "Characteristics of Spermatozoa of Whole Ejaculate and Sperm-Rich Fraction of Dog Semen Following Exposure to Media Varying in Osmolality"; Society for Biology of Reproduction, vol. 9, No. 2; 2009; pp. 113-126.
Verstegen, John; "Cell Shield Plus—a Paradigm Shift in Semen Processing and Storage"; Minitube of America; www.minitube.com; 1 pg.
Yang, Huiping, et al.; "Development of a Simplified and Standardized Protocol with Potential for High-Throughput for Sperm Cryopreservation in Zebrafish Danio Reno"; Theriogenology 68(2): 128-136; Jun. 2007.
Zarmakoupis-Zavos, Panayota, et al.; "Occurrence of Osmotic Shock in Human Spermatozoa: Its Effects on the Qualitative Measurements of Frozen-Thawed Spermatozoa"; Middle East Fertility Society Journal; vol. 3, No. 1; 1998; pp. 66-72.
Long Term Semen Extenders; Minitube of America; www.minitube.com; 1 pg.
Animal Reproduction Technology—Porcine; Minitube of America; www.minitube.com; Jan. 2012; 40 pgs.
Low Dose Insemination; Minitube of America; www.minitube.com; Jun. 2012; 3 pgs.
Benefits of Extender Component CSP™ Prove to be Multifaceted; MINITÜB GmbH; http://www.minitube.us; Oct. 8, 2010; 2 pgs.
Experience With Implementing Post-Cervical AI Programs; Swine Breeding Management Workshop—Western Hog Journal; Fall 2011; pp. 30-32.
Semen Tube-Semen Tube Manufacturers, Suppliers and Exporters on Alibaba.com; http://www.alibaba.com/showroom/semen-tube.html; retrieved from the internet Apr. 11, 2012; 15 pgs.
Semen Catheter for Pig Artificial Insemination Products on Alibaba.com; http://www.alibaba.com/product-gs/482831008/Semen_catheter_for_pig_artificial_insemination.html; retrieved from the Internet Apr. 10, 2012; 16 pgs.
Semen Bag Products, buy Semen Bag Products from Alibaba.com; http://www.alibaba.com/product-gs/273883560/Semen_bag.html; retrieved from the internet Apr. 10, 2012; 2 pgs.
Artificial Insemination and Embryo Transfer; http://www.vetmed.1su.edu/elitslotus/theriogenology-5361/artificial%20insemination_4.htm; retrieved from the internet Apr. 25, 2012; 9 pgs.
Soil Moist Stores Water and Releases it As Plants Need It; http://www.soilmoist.com/products/soil-moist.php; retrieved from the internet Jun. 4, 2012; 4 pgs.
Singeton, Wayne L.; "A Guide to Basic Boar Semen Collection, Evaluation and Processing Procedures"; Purdue University—Dept. of Animal Sciences; http://www.ansc.purdue/edu/swine/porkpage/repro/pubs/basic2.htm; retrieved from the Internet Apr. 25, 2012; 6 pgs.
More on Frozen Semen; Goulburn Valley Equine Hospital; http://www.gvequine.com.au/reproduction/frozen-semen/more-on-frozen-semen; retrieved from the internet Apr. 25, 2012; 7 pgs.
Processing Fresh Semen; Swine Genetics International—Artificial Insemination Semen and Products; http://www.swinegenetics.com/ai_catalog/ai_processing.html; retrieved from the internet Apr. 11, 2012; 3 pgs.
Fresh Express® Kit—Inventory List; Synbiotics Corporation, Kansas City MO; www.synbiotics.com; 7 pgs.
Soil Moist Starch Polymer; JRM Chemical, Inc.; www.soilmoist.com; © 1996; Rev. 02/03; 1 pg.
Environmental Spill Encapsulant Polymers; H-100 Hydrocarbon Encapsulant; JRM Chemical, Inc.; 1 pg.
Superabsorbent Aqueous Based Polymers; JRM Chemical, Inc.; © 1996; Rev. 6/96; 2 pgs.
MSDS Material Safety Data Sheet, Soil Moist Disks; JRM Chemical, Inc.; Aug. 1994; 2 pgs.
MSDS Material Safety Data Sheet, Fines; JRM Chemical, Inc.; May 22, 1998; 2 pgs.
Superabsorbent Aqueous Based Polymers from Soil Moist; http://www.soilmoist.com/products/industrial; php; JRM Chemical; retrieved from the internet Jun. 4, 2012; 2 pgs.
Environmental Spill Encapsulant Polymers from Soil Moist; http://www.soilmoist.com/products/environmental.php; JRM Chemical; retrieved from the internet Jun. 4, 2012; 2 pgs.
Chapter 12—Semen and its Components; http://nongae.gsnu.ac.kr/~cspark/teaching/chap12.html; retrieved from the internet Apr. 18, 2012; 5 pgs.
Thermoplastic Elastomer—Wikipedia; http://en.wikipedia.org/wiki/Thermoplastic_elastomer; retrieved from the internet Jun. 5, 2012; 4 pgs.
Semen Extender—Wikipedia; http://en.wikipedia.org/wiki/Semen_extender; retrieved from the internet Apr. 10, 2012; 3 pgs.

* cited by examiner

MULTI-COMPARTMENT CONTAINER FOR BIOLOGICAL LIQUIDS

FIELD OF THE INVENTION

This invention relates to a container having multiple chambers for containing biological liquids, more particularly, biological liquids used in the artificial insemination of animals.

BACKGROUND OF THE INVENTION

Artificial insemination (AI) and embryo transfer are widely used techniques for delivering biological liquids containing semen or embryos into the reproductive tract of a female animal. Such techniques are routinely used in livestock breeding and introducing new genetic lines into an animal herd, especially dairy cattle and swine (pigs).

Artificial insemination techniques for livestock typically utilize liquid extended semen. In practice, fresh semen collected from a boar is combined with a semen extender, an aqueous solution used to dilute the ejaculate to obtain a large number of doses that can be used for inseminating multiple sows, e.g., up to 200 sows.

The extender functions to provide membrane stabilization in cool storage temperatures, an energy source for sperm metabolism, pH buffering, ions for membrane and cell balance, and antibiotics to prevent microbial growth. The proper extension of semen is critical to the success of the insemination procedure, and it is vital that extended semen doses possess acceptable characteristics to be capable of impregnating a gilt or sow which is inseminated at the appropriate time. In the U.S., artificial insemination protocols for swine recommend carrying out inseminations with a dose of 70 to 90 ml (cc) containing 3 to 3.5 billion spermatozoa per dose. European protocols typically use about 1.5 billion sperm per dose.

Extending the semen needs to be done while preserving the functional characteristics of the sperm cells (spermatozoa). Seminal plasma within the ejaculate supplies the sperm cells with nutrients for a limited period. To preserve the sperm cells for an extended period, their metabolic activity is reduced by diluting the cells in an appropriate liquid extender medium and lowering the temperature. To perform its function, the extender should supply the nutrients needed for the metabolic maintenance of the sperm cell (glucose), afford protection against cold shock (BSA), control the pH (bicarbonate, TRIS, HEPES) and osmotic pressure (NaCl, KCl) of the medium, and inhibit microbial growth (antibiotics).

In current semen extension processing, the fresh semen is diluted with a semen extender to the desired dosage concentration and the dose amount (e.g., 80 cc) is dispensed into and sealed within a semen container as a ready-to-use semen dose. In a livestock insemination procedure, the container holding the semen is attached to a semi-rigid tube or catheter which has been inserted into the female animal (sow/gilt) to be inseminated. Muscular contractions then aid in drawing the seminal fluid into the body of the sow or gilt.

Excessive or abrupt dilution of semen or the exposure of spermatozoa to a solution with a relatively high concentration of solutes (hypertonic solution) can lead to what is known as a 'dilution effect' or osmotic shock and a permanent loss of motility, metabolic activity and fertilizing capacity. Generally, when sperm cells are exposed to a hypertonic solution (e.g., an extender solution), water is initially drawn out of the cells into the surrounding medium resulting in dehydration and shrinkage of the cells, followed by an influx of water causing the cells to swell to balance the internal and external osmotic pressures. If the semen extender is abruptly added (or the semen is excessively diluted), cell shrinkage and swelling can occur rapidly and excessively resulting in physical damage to the cells with a loss of sperm motility and function. For this reason, the semen should be diluted slowly or by stepwise addition of the extender to allow for a gradual osmotic adjustment between intra- and extracellular fluids to minimize osmotic shock. However, this is both tedious and time consuming.

Other problems in extending the semen concern the protracted exposure of the sperm cells to certain solutes, which can be detrimental causing toxic injuries to the cells. In addition, the amount and composition of semen extender and number of sperm cells for currently practiced insemination dose amounts gives rise to high production costs and an economic impact on a breeding operation.

Containers for holding semen are known. For example, U.S. Pat. No. 8,025,855 (Kuhlow) discloses a semen container having a hollow body with an open, sealable end and a nozzle at the opposing end fitted with a removable tip. In another example, U.S. Pat. No. 6,551,819 (Simmet) discloses a container for semen and other biological liquids that includes a nozzle for delivery of the liquid with means for bending of the nozzle such that the container can be positioned in a vertical alignment while attached to a horizontally aligned catheter without kinking of the container or catheter which can hinder delivery of the biological liquid from the container to the animal. The vertical positioning of the container facilitates gravity flow, which assists the transfer of the biological liquid from the container into the catheter and the sow/gilt being bred.

Known sperm containers are structured to contain an insemination dose of 80 to 100 ml containing 3 to 3.5 billion sperm cells, which requires careful processing to avoid osmotic shock during the dilution process. In addition, with current containers, sperm cells are continuously exposed to the solutes of the extender solution without the ability to modify the solution during the storage period.

It would be desirable to provide a container for an insemination dose that overcomes the foregoing problems.

SUMMARY OF THE INVENTION

The present invention provides a multi-chambered container for containing two different liquids and allowing for the flow of one liquid into the other liquid.

The containers of this invention advantageously may be used to store and transport semen for the artificial insemination of animals, particularly swine and other livestock. In such applications, the containers of the invention are structured for containing an aliquot of extended semen in one compartment, and an aliquot of semen extender or other fluid in a separate but connected compartment.

In embodiments, the biological liquid within one of the compartments comprises extended semen, and the biological liquid within the other compartment comprises a fluid without sperm cells. In embodiments, the construction of the containers allows for the containment of an aliquot of about 15 to 35 ml of extended semen having a concentration of spermatozoa as low as 500 million sperm cells in one compartment, and an aliquot of about 30 to 50 ml of semen extender or other biological liquid (without sperm cells) in the other compartment. A conduit section interconnects the two compartments. In embodiments, the conduit section can be completely closed (sealed) (e.g., with a plug) to contain the biological liquid separate from the extended semen, with the plug being optionally semi-permeable to allow passage of nutrients into the extended semen fraction. In other embodiments the conduit section can be partially closed to provide separate containment of the biological liquid from the extended semen while providing a channel for a minimal but continuous flow of the biological liquid into the extended semen solution, or by an exchange of liquid and/or nutrients through diffusion and osmotic pressure equilibration. In yet other embodiments, the conduit section can be constructed with an inner diameter that provides an air pocket that separates the two fluids by surface tension.

Through the use of the containers of the invention, the number of sperm cells and volume of the inseminate can be reduced by six- to seven-fold compared to current standard amounts without lowering the fertility result or litter size, which allows for a larger number of insemination doses that can be obtained from a single ejaculate. The containers also eliminate the need for multi-step dilution of the semen. In addition, embodiments of the container structure provide for continuous feeding of nutrients to the extended sperm fraction to maintain viability of the sperm cells, e.g., through the use of a porous plug or by providing a channel around the plug within the conduit section.

In embodiments, the container comprises a first compartment connected by a conduit section to a second compartment, with the first compartment having a first end being sealable and a second end connected to one end of the conduit section, the second compartment having a first end connected to an opposing end of the conduit section and a second end comprising a nozzle, and the conduit section having a channel extending therethrough and structured to contain a fluid within the first compartment substantially separate from a fluid within the second compartment.

In embodiments, the container has a hollow body of a molded plastic material and a first compartment connected by a conduit section to a second compartment. The first compartment has a first end that is sealable and a second end that is integrally molded to one end of the conduit section. The first end of the second compartment is integrally molded to the opposing end of the conduit section and the second end has an integrally molded nozzle having an inner diameter and a closed end. The conduit section has a channel that extends therethrough, which, in embodiments, is fully closed (sealed) to contain a fluid within the first compartment, or partially open to maintain a passageway for the fluid to pass into the second compartment, or fully open but with an inner diameter that maintains an air pocket between the two fluids. In embodiments, the second compartment is structured to contain extended semen, and the first compartment is structured to contain a biological fluid that does not contain sperm cells.

In one embodiment, the container is structured with an unattached and movable spherical mass (sphere) situated within the body, which is initially located within the first compartment, and can be sequentially positioned within the conduit section and then within the second compartment. In embodiments, the first compartment is structured with one or more ridges or protuberances on the inner surface proximal to the conduit section, to block entry of the spherical mass into the conduit section. The conduit section is sized to receive the spherical mass therein to seal the conduit section or, in other embodiments, to maintain a channel between the spherical mass and the wall of the conduct section to allow passage of liquid therethrough. The spherical mass can be porous to allow passage of fluid therethrough. In embodiments, the second compartment is structured with one or more ridges or protuberances on the inner surface proximal to the nozzle, to block entry of the spherical mass into the nozzle.

In another embodiment, the conduit section of the container is structured with opposing arcuate sidewalls with at least one of said sidewalls configured such that an applied force against one of the sidewalls inverts and positions the sidewall into a nesting relationship within the opposing sidewall while maintaining a channel for passage of liquid from the first compartment into the second compartment.

In yet another embodiment, the conduit section of the container is structured with opposing sidewalls with an adhesive element on the inner surface of one or both of the sidewalls. Upon the application of force onto the outer surface of the sidewalls, the adhesive element(s) seals the conduit section or, in other embodiments, a channel can be maintained for passage of liquid therethrough.

In a further embodiment, a rod-shaped plug is inserted through the conduit section to fully or partially seal the channel, and is secured in the end tab or flange of the nozzle of the container. To open the channel of the conduit section, the end tab or flange can be twisted off and removed with the attached rod-shaped plug.

In another embodiment, the conduit section can be structured with a channel having a small inside diameter (i.d.) that allows for insertion therethrough of a fluid delivery nozzle to deliver fluid into the second compartment, and maintains an air pocket to separate the fluids in the first and second compartments without the need for a plug or other closure element.

In yet another embodiment, the container comprises two sheets of plastic sealed together to define the first and second compartments and the conduit section of the container. The container can be formed by heat sealing plastic sheets together to define the container body, i.e., the compartments, conduit section and nozzle.

In use, the second compartment can be first filled (partially or completely) with an aliquot of a biological fluid (e.g., extended semen, etc.) and, in embodiments, the channel through the conduit can be closed or semi-closed, the first compartment filled with an aliquot of a second biological fluid (e.g., semen extender without spermatozoa), and the open end of the container sealed. For delivery of the biological fluids from the container, the closed end of the nozzle of the container can be opened, the nozzle inserted into a catheter and the container positioned in a vertical orientation. The fluid within the second compartment can be dispensed through the nozzle into the catheter, and pressure then applied to the fluid within the first compartment to force the fluid through the channel into the second compartment and through the nozzle into the catheter. In embodiments, pressure applied to the fluid in the first compartment can force a plug that may be present out of the channel of the conduit section and into the second compartment.

In embodiments in which the container is structured with a rod-shaped plug inserted through the channel of the conduit section and attached to a severable end tab or flange, the end tab or flange can be twisted off to open the nozzle end of the second compartment and withdrawn to remove the interconnected rod-shaped plug from the channel of the conduit. In embodiments in which the channel of the conduit section is open (without a plug or other sealing element), pressure applied to the fluid in the first compartment can force the fluid through the open channel into the second compartment and out through the nozzle.

In embodiments using a container having an open channel through the conduit section without a plug or other closure element, the first and second compartments can be separately or simultaneously filled with the first and second biological fluids. The compartments can be filled, for example, by delivering the fluid (e.g., extended semen) into the second compartment through a first delivery nozzle inserted through the channel of the conduit section, and simultaneously delivering fluid (e.g., extended semen) into the first compartment through a second delivery nozzle. As the delivery nozzles are removed, the first delivery nozzle is withdrawn through the channel of the conduit section and an air pocket remains within the channel to maintain a separation of the fluid (e.g., extended semen) within the second compartment from the fluid (e.g., semen extender) in the first compartment without the use of a plug within the channel.

In embodiments of the use of the multi-compartment containers in an artificial insemination procedure of an animal, the second compartment can be filled with an aliquot of extended semen, the channel of the conduit can be closed or semi-closed where applicable (e.g., in use of a container structured with a plug), and the first compartment can be filled with an aliquot of semen extender or other biological fluid to provide the necessary physiological volume for insemination. In an insemination procedure, the closed end of the nozzle of the container can be opened and an insemination catheter that has been inserted into a female animal to be inseminated, seated into the inner diameter of the nozzle. The container can then positioned in a vertical alignment to the horizontally aligned catheter. Muscular contractions aid in drawing the fluids from the container into the animal to be inseminated.

In embodiments, the fluid (e.g., semen extender) contained in the first compartment can be formulated as an activation medium ("AM" fluid) to stimulate sperm cell activity and motility and the extended semen contained in the second compartment can be formulated in a preservation medium ("PM" fluid) to maintain the sperm cells at a low metabolism and enhance toleration of stressors during storage and transport.

In embodiments in which the container is structured with a spherical mass to partially close the conduit section, with the nozzle of the container attached to the insemination catheter, the spherical mass can be dislodged from the conduit section into the second compartment by squeezing the sides of the first compartment, which results in the discharge of the biological liquid (e.g., semen extender) from the first compartment through the channel of the conduit section into the second compartment and through the nozzle into the insemination catheter. The aliquots of extended semen and biological fluid (with sperm cells) are drawn into the catheter and the body of the sow or gilt by muscular contractions of the animal.

In embodiments in which the conduit section of the container is structured with opposing arcuate sidewalls that are positioned in a nested relationship to partially close the channel through the conduit section, the sidewalls can be forced out of their nested relation to discharge the biological liquid from the first compartment through the channel of the conduit section into the second compartment and through the nozzle into the insemination catheter.

In other embodiments in which the conduit section of the container is structured with opposing sidewalls releasably attached by an adhesive element to fully or partially close the channel through the conduit section, the sidewalls are forced apart to discharge the biological liquid from the first compartment through the channel of the conduit section into the second compartment and through the nozzle into the insemination catheter.

In another embodiment of a container configured for simultaneous filling of the first and second compartments, the conduit section of the container has a channel with an inner diameter (i.d.) effective to maintain an air pocket therein between fluids within the first and second compartments during filling, and the nozzle at the second end of the second compartment comprises an opening that is sized for receiving a tube (e.g., straw) therethrough for delivery of fluid into the second compartment. In embodiments in which the nozzle terminates in an end having a severable tab extending therefrom, an opening for receiving the tube therethrough can extend through the tab to the second compartment. While filling the second compartment with fluid through the tube, fluid can be simultaneously delivered into the first compartment through a cannula or other filling device. After filling, the opening to the first compartment can be sealed, and the first end of the tube can be advanced through the second compartment and into the channel of the conduit section, which is sized for receiving the tube (or straw) therethrough, to fully or partially close the channel, and the second end of the tube (positioned within the opening in the nozzle or through the severable tab) can be sealed. In use, the nozzle of the second compartment can be opened and a catheter connected to an animal inserted to deliver the fluid from the container as described previously.

BRIEF DESCRIPTION OF THE DRAWINGS

FIG. 3 is a cross-sectional view of the container of FIG. 1 showing the second compartment of the container being filled with a liquid. FIG. 4 is a cross-sectional view of the container shown in FIG. 3 in a subsequent step, showing withdrawal of the filling device and the spherical mass moved toward the conduit section of the container. FIG. 5 is a cross-sectional view of the container shown in FIG. 4 in a subsequent step, showing the spherical mass being inserted into the channel of the conduit section of the container. FIG. 6 is a cross-sectional view of the container shown in FIG. 5 in a subsequent step, showing the first compartment of the container being filled with a liquid. FIG. 7 is a cross-sectional view of the container shown in FIG. 6 in a subsequent step, showing an AI catheter inserted into the nozzle. FIG. 8 is a partially cut-away, cross-sectional view of the container shown in FIG. 7 in a subsequent step, showing the spherical mass dislodged from the conduit section and the liquid in the second compartment drawn into the AI catheter. FIG. 9 is a partially cut-away, cross-sectional view of the container shown in FIG. 8 in a subsequent step, showing the spherical mass within the second compartment and the liquid from the first compartment being drawn into the AI catheter.

FIGS. 10-11 show the container filled with biological liquids. FIG. 10 is a cross-sectional view of the container showing the second compartment filled with a liquid. FIG. 11 is a partially cut-away, cross-sectional view of the container shown in FIG. 10 in a subsequent step, showing the sidewalls of the conduit in a nested relation and liquids contained within the first and second compartments. FIG. 12 is a partially cut-away view of the container shown in FIG. 11 in a subsequent step, showing the conduit section fully open and the liquids being dispensed from the container.

FIGS. 13-14 are front cut-away views showing the container filled with biological liquids. FIG. 13 is a partial cut-away, cross-sectional view of the container showing the second compartment filled with a liquid.

FIG. 14 is a partially cut-away, cross-sectional view of the container shown in FIG. 13 in a subsequent step, showing the adhesive element in the conduit adhered together and liquids contained within the first and second compartments.

DETAILED DESCRIPTION OF THE PREFERRED EMBODIMENT

Embodiments of the invention relate to a multi-compartment container for holding biological liquids.

The term "biological liquid(s)" refers to a biological fluid or liquid medium or biological cells in a liquid or fluid medium. Examples of biological liquids include semen and seminal fluids that may include sperm cells and seminal plasma, extended semen, cultured tissue such as biological cells useful for the purposes of breeding and reproduction such as oocytes, embryos or combinations thereof, and culture media, semen extenders, diluents, stimulating solutions (e.g., caffeine, etc.), and antimicrobial agents, pH buffering agents, fillers, solvents, dispersants and other additives, and combinations thereof.

A first embodiment of a multi-compartment container 10 according to the invention is described with reference to FIGS. 1-9.

Figure 1:
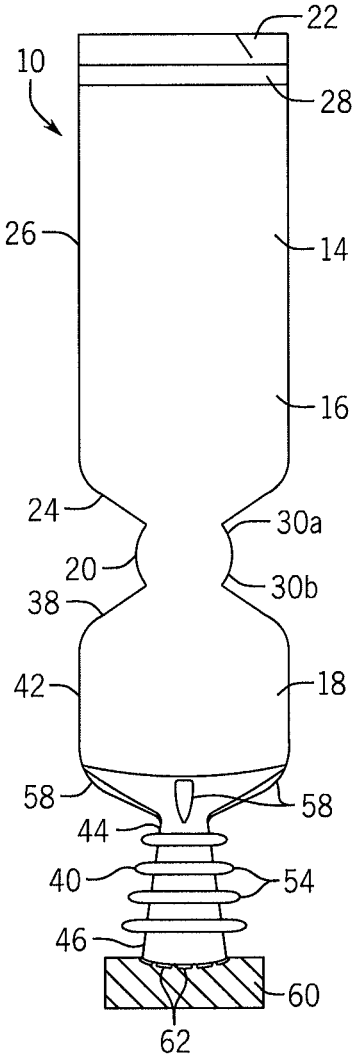
FIG. 1 is a front plan view of an embodiment of a multi-compartment container according to the invention.
Figure 1A:
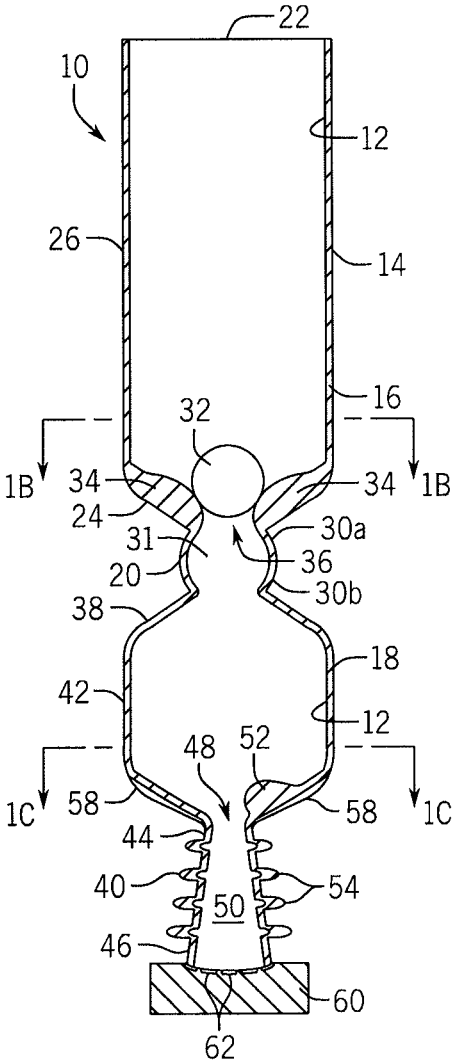
FIG. 1A is a cross-sectional, side elevational view of the container of FIG. 1.

As shown in FIG. 1 (plan view) and FIG. 1A (cross-sectional view), the container 10 has a hollow body made of a molded plastic material with an inner surface 12 and an outer surface 14. The container 10 is composed of a first compartment 16 interconnected to a second compartment 18 by means of a conduit section 20.

The first compartment 16 has a first end 22, a second end 24 and a body 26. The first end 22 is adapted and configured for receiving a liquid into the body 26 of the container 10, and is also adapted for forming a fluid tight seal at a sealing section 28 near the end of the container. The second end 24 is integrally molded to one end 30*a* of the conduit section 20 having a channel 31 therethrough A spherical mass 32, which is unattached and freely movable, is initially situated within the body 26 of the first compartment 16. The spherical mass can be composed of a solid or resiliently compressible material, for example, of a biocompatible silicone, wax, gel, glass, metal, plastic, thermoplastic elastomer (TPE such as chips or pellets of thermoplastic polyurethane (TPU), among other materials, and can be porous or permeable to allow the flow of fluid therethrough. Another useful spherical mass can be composed of an absorbent, water-insoluble polymer that swells or gels in aqueous fluid such as water but does not dissolve in the fluids, for example, polyacrylamides, starch graft copolymers and starch-based polymers, such as Soil Moist™ starch polymers (JRM Chemical Inc., Cleveland, Ohio) and polymers such as those described in U.S. Pat. No. 8,017,553 (Doane), and polymeric materials such as H-100 or H-600 polymers (JRM Chemical Inc.). In use, granules of an absorbent polymer can be reconstituted in water to provide a gel-like mass that can be delivered into the first compartment. The spherical mass can be heat sterilized prior to insertion into the container.

Figure 1B:
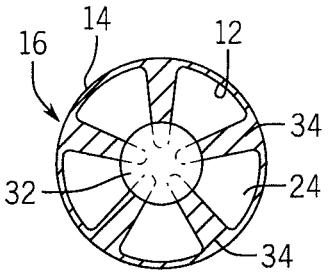
FIG. 1B is a cross-sectional view of the container taken along lines 1B-1B of FIG. 1A.

Referring to FIGS. 1A and 1B, the first compartment 16 is structured with one or more protuberances 34 on the inner surface 12 proximal to the second end 24 at the juncture with the conduit section 20. The protuberance(s) 34, which can be configured as one or more ridges, ribs, dimples, etc., is structured to block (obstruct) and prevent the spherical mass 32 from sealing the opening 36 to the conduit section 20.

Figure 1C:
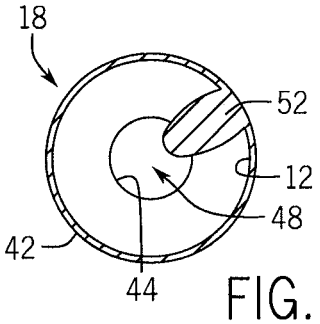
FIG. 1C is a cross-sectional view of the container taken along lines 1C-1C of FIG. 1A.
Figure 1D:
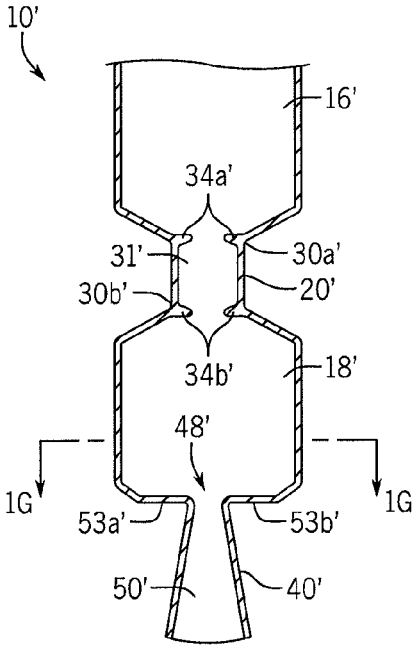
FIG. 1D is a cross-sectional side elevational view of another embodiment of a container showing protuberances at either end of the conduit section and ridges in the second compartment alongside the opening to the nozzle.
Figure 1G:
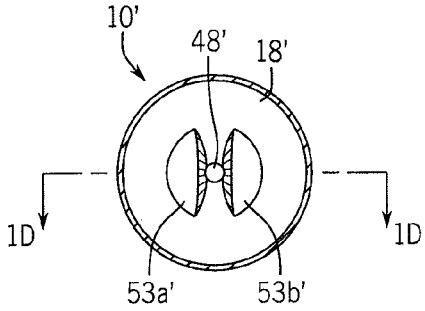
FIG. 1G is a cross-sectional view of the container of FIG. 1D taken along lines 1G-1G.
Figure 1E:
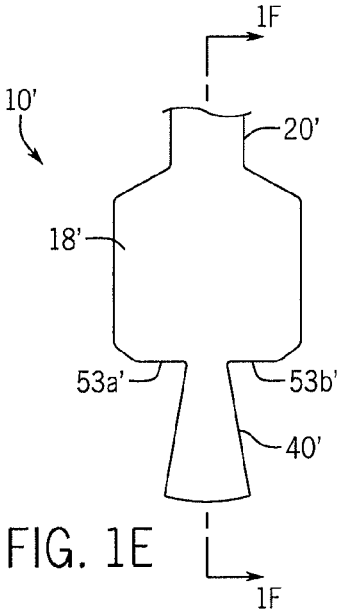
FIG. 1E is a front plan view of the container of FIG. 1D.
Figure 1F:
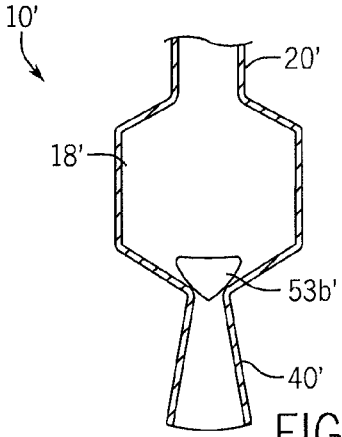
FIG. 1F is a side plan view of the container taken along lines 1F-1F of FIG. 1E.

In another embodiment illustrated in FIG. 1D, the first end 30*a*' of the conduit section 20' can be structured with protuberances 34*a*' that block the spherical mass 32' from sealing the opening 36' (and protuberances 34*b*' that retain the spherical mass 32' within the channel 31' of the conduit section).

As depicted in FIG. 1A, the second compartment 18 has a first end 38, a second end 40 and a body 42. The first end 38 is integrally molded to the opposing end 30*b* of the conduit section 20. The second end 40 is an integrally molded, rigid nozzle with a first end 44, a second end 46, an opening 48 and a channel 50. In embodiments, the second end 46 of the nozzle 40 has a diameter greater than the inner diameter of the first end 44, which is sized for seating an end of an insemination catheter therein.

Referring to FIGS. 1A and 1C, the second compartment 18 is structured with at least one protrusion 52 on the inner surface 12 proximal to the juncture of the body 42 with the first end 44 of the nozzle 40. The protrusion(s) 52 can be configured as one or more ribs, dimples, etc., which are structured to obstruct the spherical mass 32 from sealing the opening 48 to the channel 50 of the nozzle 40. In an embodiment illustrated in FIGS. 1D to 1G, the second compartment 18' is structured to provide ridges 53*a*', 53*b*' alongside the opening 48' which prevent the spherical mass (not shown) from entering the opening 48'.

In embodiments, the nozzle (second end) 40 includes bendable elements 54, for example, one or more accordion folds, corrugations, or a combination thereof, which permits the nozzle 40 to be bent without forming kinks in either the nozzle or the body of the container 10. "Corrugations" refer to a rounded protrusion extending either inward or outward, preferably outward, from the nozzle surface, for example, as shown in FIGS. 1-1A. The wall thickness in the corrugation is generally equal to or thinner than the wall thickness in the straight sections of the nozzle. "Accordion folds" are generally V-shaped folds. Embodiments of a nozzle having such bendable elements are described, for example, in U.S. Pat. No. 6,551,819 (Simmet).

Figure 7:
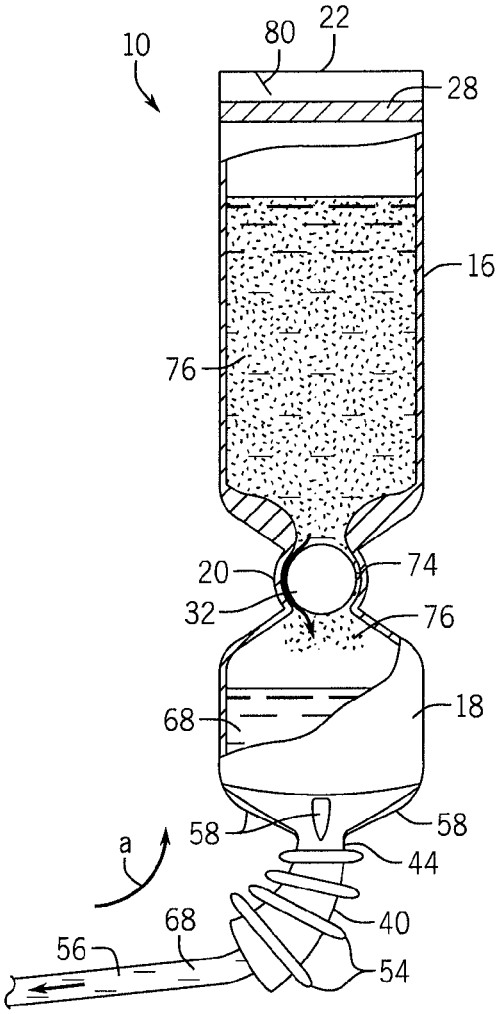
Figure 7A:
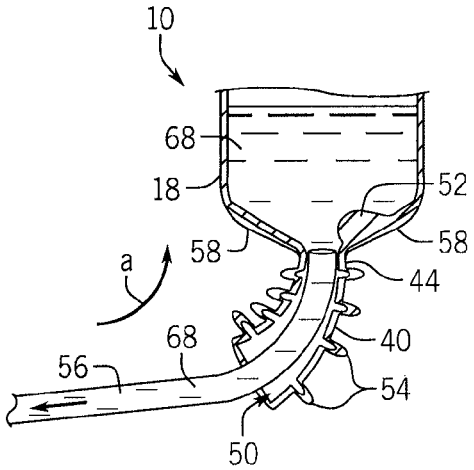
FIG. 7A is a cross-sectional, partial view of the container shown in FIG. 7 showing the AI catheter seated in the first end of the nozzle.
Figure 10:
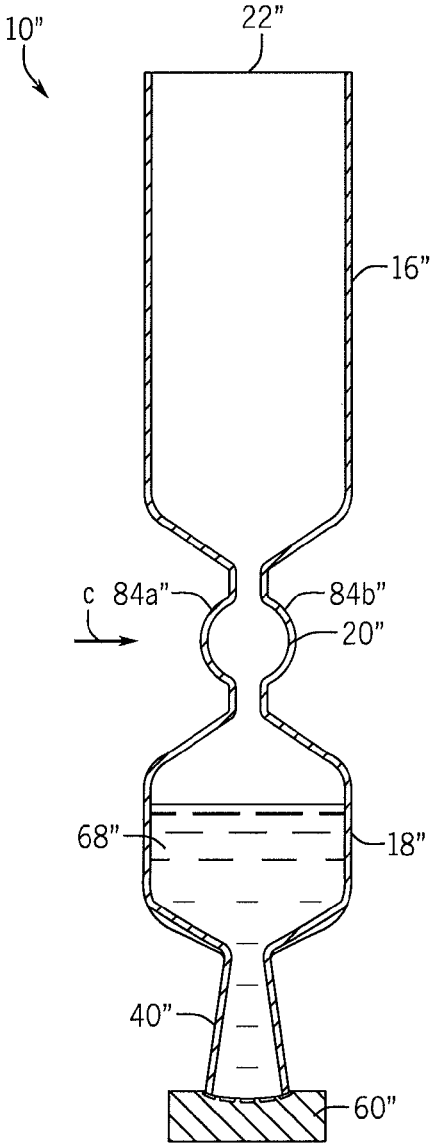
FIGS. 10-12 are cross-sectional views of another embodiment of a multi-compartment container according to the invention.
Figure 11:
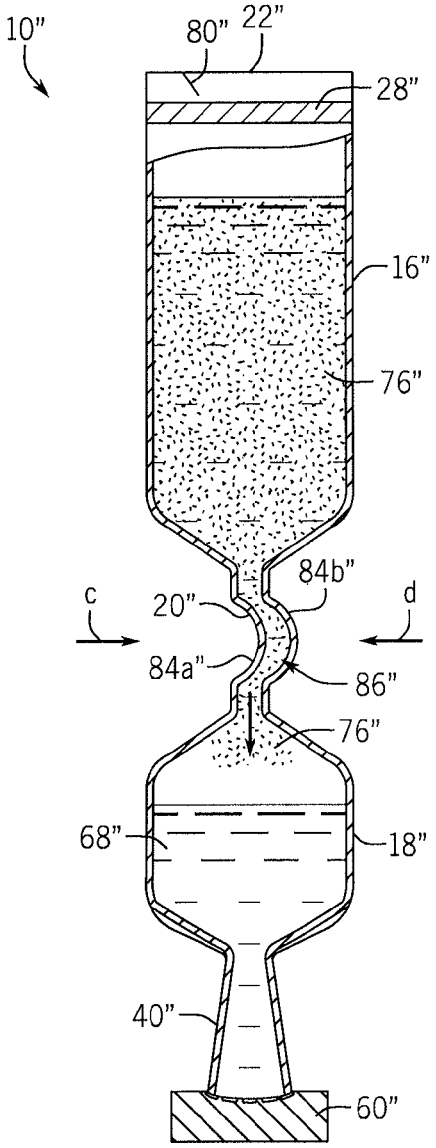
Figure 12:
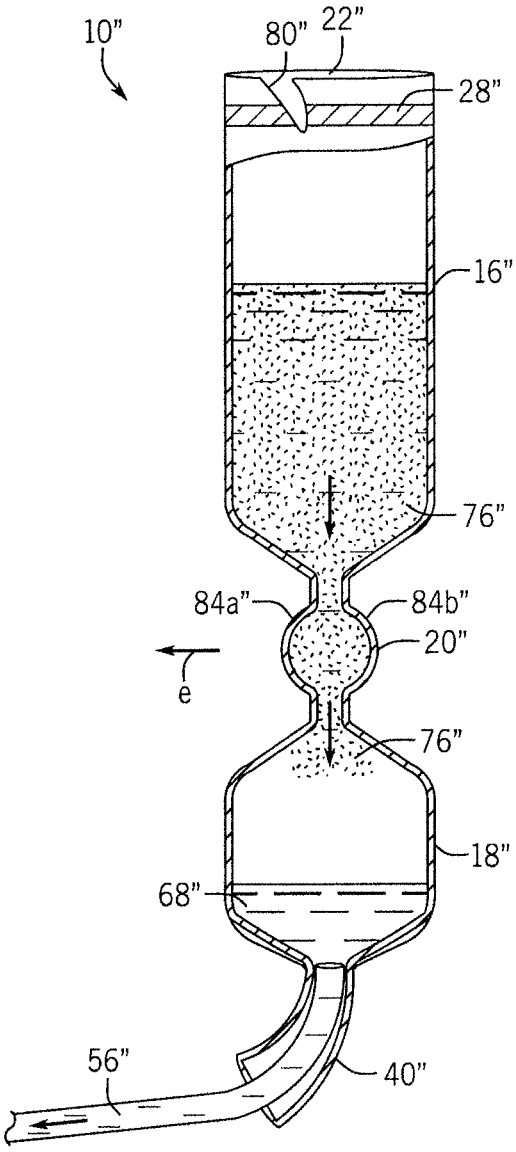

In use during an artificial insemination procedure, with the container 10 and nozzle 40 in a horizontal alignment, an insemination catheter 56 which has been inserted into the animal's body, is inserted into the channel 50 and seated in the first end 44 of the nozzle 40 (with reference to FIGS. 7-7A). The bendable elements 54 of the nozzle 40 permit the container 10 to be pivoted and aligned in a vertical plane perpendicular to the insemination catheter 56 without forming kinks in the nozzle or the body of the container 10. As illustrated in FIGS. 10-12, in other embodiments the nozzle 40" can be fabricated from a semi-rigid plastic material that will flex without bending elements.

The nozzle 40 should have sufficient rigidity to allow insertion of the insemination catheter 56 into the first end 44 of the nozzle 40. In embodiments, the body 42 of the second compartment 18 proximal to the nozzle (second end) 40 can be reinforced, for example, by increasing the body wall thickness and/or by reinforcement ribs 58 as shown in FIGS. 1-1A.

In embodiments, the end 46 of the nozzle 10 is sealed by a severable section 60 such as a tab or flange extending therefrom, which can be manually twisted off along a score line 62 to open the end 46 without the use of tools. This embodiment allows the user to avoid cutting the container nozzle with a knife, thereby decreasing the occurrence of microbial contamination or cross contamination of the semen held within the container.

The walls of the container body are typically made from a non-spermicidal material, preferably a flexible plastic material. Examples of suitable plastics include polyolefins (such as polyethylene, polypropylene etc.), polyvinylchloride, nylons, polyfluorocarbons, thermoplastic polyurethanes, polystyrene, elastomers, cellulosic resins, acrylic resins and silicones, preferably polyolefins and elastomers. The containers of the invention can be produced by conventional molding techniques such as injection molding, blow molding, extrusion molding, thermoforming and other processing techniques that are well known to those skilled in the art of plastics processing.

During an artificial insemination procedure, the pumping action of muscular contractions within the animal and the drainage of the biological liquid from the container 10 are believed to exert a partial vacuum within the container. Preferably, the walls are thin enough such that the container body will collapse upon the application of a partial vacuum within the lumen of the container. If the walls are too rigid, the partial vacuum can persist and hinder the flow of the liquid from the container. The collapse of the flexible walls of the container relieves the partial vacuum and facilitates a rapid flow and near complete drainage of the biological liquid from the container. The rigidity of the walls can be varied by the wall thickness according to the application. An example of a tube having a suitable wall thickness for the desired wall collapse is the ULTRAFLEX™ boar semen tube available from Minitube of America, Inc., Verona, Wis. USA.

The body wall thickness near the first end 22 of the first compartment 16 to provide a more stable opening for filling the container 10 and a more stable material for sealing the container. The body wall thickness of the first and second compartments 16, 18 can also be increased at the junction with the conduit section 20 for added stability.

Figure 2A:
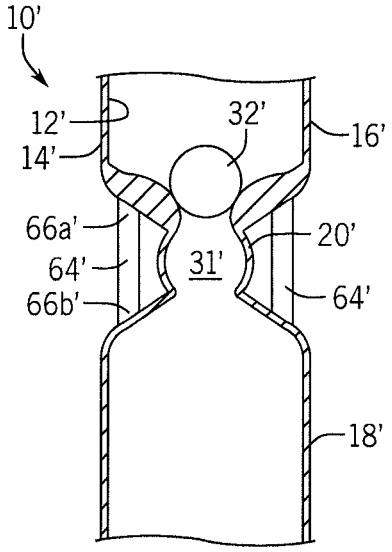
FIG. 2A is a cross-sectional view of the container of FIG. 2.
Figure 2:
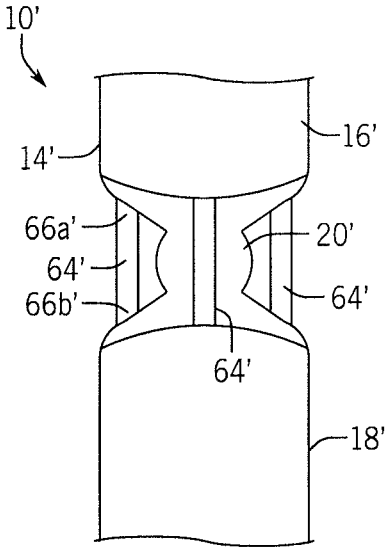
FIG. 2 is a partial front plan view of an embodiment of a container having support elements.

As illustrated in FIGS. 2-2A, in some embodiments, added stability can be provided by the inclusion of one or more support elements 64' that span between the first and second compartments 16', 18' alongside the conduit section 20'. As shown, opposing ends 66*a*', 66*b*' of the support elements 64' can be integrally molded to the outer surface 14' of the first and second compartments 16', 18' alongside and spaced apart from the conduit section 20'. The space between the support elements 64' and the conduit section allows for expansion or stretching of the conduit section to receive the spherical mass 32' inside.

The container 10 can be provided to a stud farm with the first end 22 of the first compartment 16 open, and the opposing end 46 of the nozzle 40 sealed, e.g., by a severable tab or flange 60. The container can then be filled with extended semen in one compartment 18 and a semen extender or other biological fluid in the other compartment 16, and sealed for storage and later use.

Figure 3:
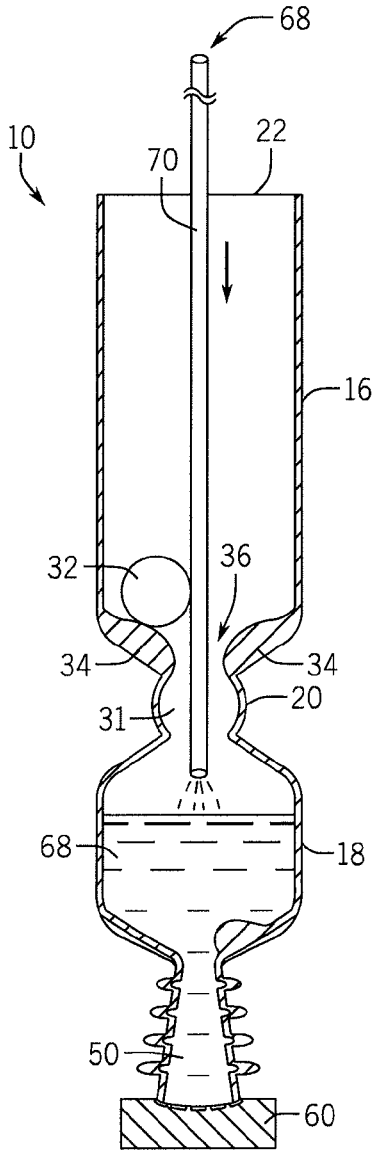
FIGS. 3-9 are cross-sectional views showing the use of the container of FIG. 1 at sequential process steps to fill the container with biological liquids and dispense the liquids in an artificial insemination procedure according to an embodiment of the invention.

Referring now to FIG. 3, to fill the container 10, the second compartment 18 is first filled with a biological liquid 68, e.g., an aliquot of extended semen. The second compartment 18 can be filled, for example, by introducing a filling device 70 such as a cannula, delivery nozzle, or an automatic filler known and used in the art, into the open first end 22 of the container and through the conduit section 20. As shown, the spherical mass 32 is deflected away from the opening 36 to the conduit section 20 in order to insert the filling device 70 through the conduit section and into the second compartment 18. In embodiments, the second compartment 18 can be fully filled with fluid (with substantially no air space remaining) and sealed by a plug (e.g., a gel plug, etc.) pushed into the channel 31 of the conduit section 20 to force air out of the compartment 18.

The second compartment 18 can also be filled by manually pouring the liquid into the first compartment 16 and allowing the liquid to flow through the conduit section 20 into the second compartment 18. The protuberances 34 function to block the spherical mass 32 from sealing the opening 36 to the conduit section 20.

Figure 4:
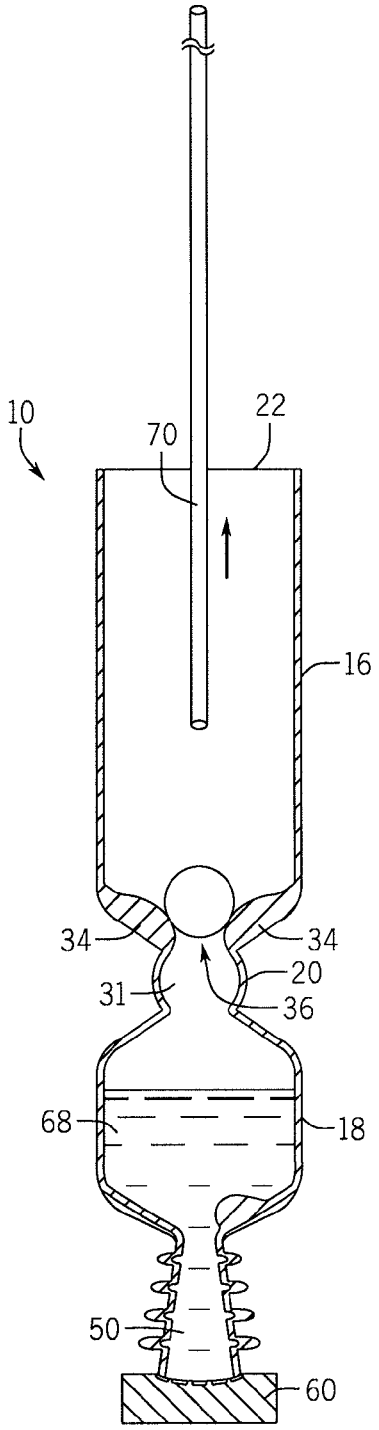

Upon filling the second compartment 18, the filling device 70 can then be withdrawn from the container 10, as depicted in FIG. 4. Upon removal of the filling device 70, the spherical mass 32 can move toward the conduit section 20 but is prevented from sealing the opening 36 to the conduit section by the protuberances 34 on the inner surface 12 of the first compartment 16.

Figure 5:
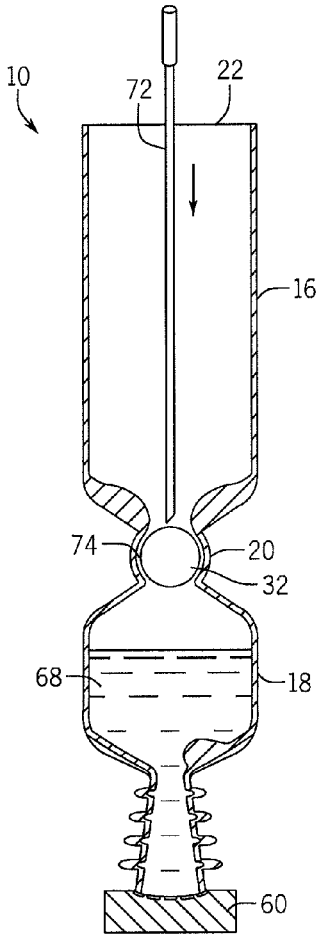

Referring to FIG. 5, the spherical mass 32 can then be forcibly inserted into the channel 31 of the conduit section 20 by contact with a rod, needle or other similar device 72. The resiliency of the flexible walls of the container 10 at the opening 36 of the conduit section 20 allows the sphere 32 to pass through the opening 36 and into the channel 31 of the conduit section. The channel 31 can be sized to receive the spherical mass 32 therein to substantially seal the channel 31. In some embodiments, the channel 31 is sized such that a channel 74 remains between the spherical mass 32 and the wall of the conduit section 20 for minimal passage of liquid therethrough.

In the embodiment illustrated in FIG. 1D, a spherical mass (not shown) can be inserted into the conduit section 20' and is retained in the channel 31' by the protrusions 34*a*', 34*b*' at either end of the conduit section.

Figure 6:
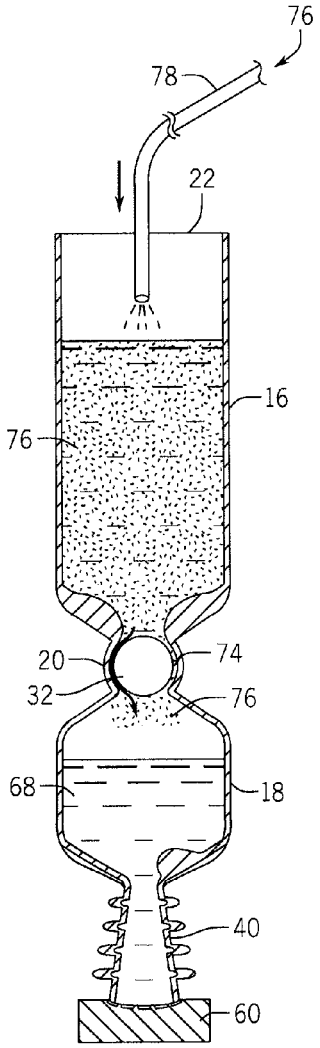

As illustrated in FIG. 6, the first compartment 16 can then be filled with a second biological liquid 76 by means of a filling device 78 such as a cannula, delivery nozzle or an automatic filler inserted into the open end of the container. The second biological liquid can comprise, for example, a culture media, semen extender, diluent, stimulating solution (e.g., caffeine, etc.), antimicrobial agent, pH buffering agent, filler, solvent, dispersant and/or other additive, and combinations and mixtures of such components. Porcine semen extenders are commercially available, for example, under the tradenames Androhep EnduraGuard™, Andohep Plus and Androstar Plus from Minitube of America, Verona, Wis. The second biological liquid 76 can comprise isotonic or slightly hypertonic diluents (300 mOsm) to regulate the osmotic pressure of the sperm material, for example, salts of inorganic ions such as sodium and potassium chloride. In embodiments, the second biological liquid 76 can be used to control the pH of the extended sperm material 68 (e.g., at pH 7.4) in the second compartment through the continuous addition of buffering agents such as bicarbonate and sodium citrate, or complex buffers such as TES, HEPES, MOPS, TRIS, etc.

In embodiments, the second compartment 18 is filled with a volume of about 15 to 20 mls of extended semen 68 containing at least about 500 million sperm cells up to about 875 million, or up to about 750 million sperm cells or more, and in some embodiments up to 3 billion sperm cells. The first compartment 16 can be filled with a volume of about 30 mls up to about 50 mls of a compatible semen extender 76 to provide a total combined volume (with the extended semen) of at least about 50 mls up to about 70 mls to ensure adequate transport of spermatozoa for insemination of the sow/gilt. Where the extended semen 68 is at the lower concentration of 500 million sperm cells per 15 to 20 mls, one or more additives and/or nutrients can be included which will function to reduce or prevent dilution shock and maintain semen quality.

As shown in FIG. 7, after filling, the first end 22 of the first compartment 16 can be sealed along a sealing section 28 by any appropriate sealing means, for example, by heat sealing, ultrasound, infrared or wire sealers. In embodiments, the first end 22 includes scoring 80, e.g., a cut (slit) or score line, through both walls to facilitate tearing open the sealed section during an insemination procedure to release the vacuum which will form inside of the container 10. Preferably, the scoring or cut 80 is at an angle of less than 90 degrees (i.e., less than perpendicular) to the sealing section 28, and preferably at an angle of about 45 degrees.

The sealed container 10 can be used immediately or stored according to protocol (temperature, etc.). During the storage period, the second biological liquid 76 can flow or diffuse through the channel 74 into the biological liquid 68 (e.g., extended semen) within the second compartment 18. Clearance of the spherical mass 32 from the sidewalls of the conduit section 20 provides a channel 74 that allows a desired exchange of fluids between the first and second compartments through equilibration of osmotic pressure differences between the two fluids. The channel 74 can be, for example, about 0.25 mm to 1 mm in width. The channel 74 feature of the containers of the invention can provide for a continuous inflow of fresh fluid containing, for example, fresh semen extender, a pH buffering agent, a stimulant such as caffeine, etc., into the extended semen 68 to maintain the viability of the spermatozoa during the storage period.

In use during an artificial insemination procedure, the container 10 is held in a horizontal alignment, the removable tab 60 is twisted off along the perforations 62, and an artificial insemination (AI) catheter 56 (which has been inserted into the female animal's body) is inserted into the channel 50 and seated in the first end 44 of the nozzle 40, as illustrated in FIGS. 7-7A. The reinforcement ribs 58 provide rigidity to the body 42 of the second compartment 18 to assist in inserting the AI catheter 80 into the nozzle 40. In other embodiments, the wall of the second compartment 18 can be increased in thickness near the nozzle end 44 to provide greater rigidity. As shown in FIG. 7, the bending elements (e.g., corrugations) 54 of the nozzle 40 permit the container 10 to be pivoted (arrow "a") and aligned in a vertical plane perpendicular to the insemination catheter 56 without forming kinks in the nozzle 40 or the body of the container 10.

Figure 8:
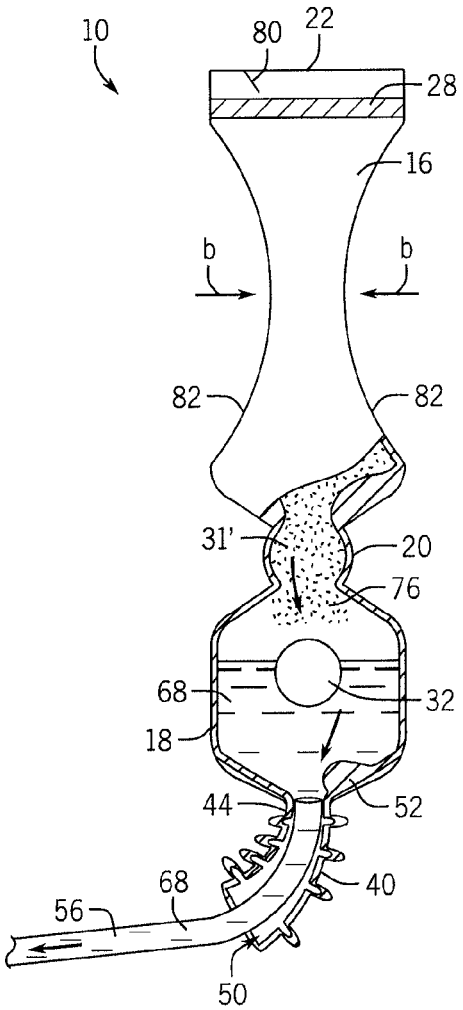

As depicted in FIG. 8, the biological liquid 68 within the second compartment 18, exemplified by extended semen, is drawn into the AI catheter 56 during an artificial insemination procedure by the pumping action of muscular contractions within the animal. It is believed that this pumping action exerts a partial vacuum within the lumen of the AI catheter 56, which draws the extended semen 68 into the catheter 56. The sides 82 of the first compartment 16 can then be squeezed together (arrows "b" in FIG. 8) to aid in dislodge the spherical mass 32 from the conduit section 20 into the second compartment 18.

Figure 9:
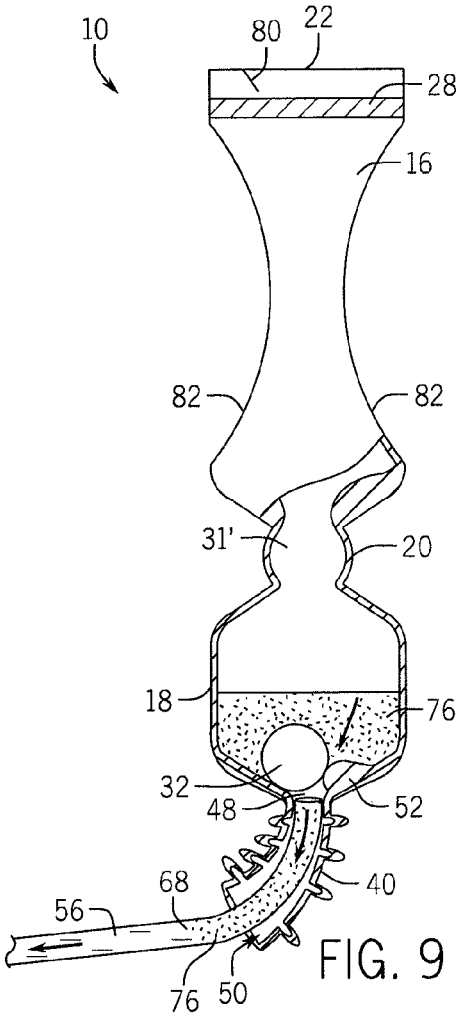

Removal of the spherical mass 32 from the conduit section dispenses the second biological liquid 76 from the first compartment 16 into the second compartment 18 and then into the insemination catheter 56 to flush the remaining extended semen 68 from the second compartment 18 and to dilute the extended semen 68 to a total volume of about 50 mls to about 65 or 70 mls for delivery into the animal. As illustrated in FIG. 9, the protrusion(s) 52 on the inner surface of the second compartment 18 prevent the spherical mass 32 from sealing the opening 48 of the nozzle 40 and allows the liquid to flow out of the container 10 into the insemination catheter 56.

The collapse of the flexible walls of the container 10 relieves the partial vacuum within the container and enables a rapid flow and near complete drainage of the biological liquids 68, 76 from the container. Tearing along the cut or score line 80 to open the sealed section 28 during the insemination procedure releases the vacuum formed inside of the container 10.

A second embodiment of a multi-compartment container 10" according to the invention is described with reference to FIGS. 10-12. This embodiment employs a different structure for the conduit section, which eliminates the spherical mass used to partially seal the conduit section described with regard to FIGS. 1-9.

As shown in FIG. 10, the container 10" is structured similar to the first embodiment with a hollow body of a molded plastic material, a first compartment 16" interconnected to a second compartment 18" by means of a conduit section 20". As illustrated, the second compartment 18" has been filled with a biological liquid 68".

In the present embodiment, the conduit section 20" is structured with opposing arcuate (curved) sidewalls 84*a*", 84*b*". As illustrated in FIGS. 10-11, at least one sidewall 84*a*" is configured to invert upon the application of force (arrow "c") and fit together in a nested relation with the opposing sidewall 84*b*" to partially close the conduit section 20" while maintaining a narrow channel 86" for the slow flow of liquid 76" from the first compartment 16" therethrough to the second compartment 18". The channel 86" can be, for example, about 0.25 mm to about 1 mm in width.

As shown in FIG. 12, during an artificial insemination procedure, the pumping action from muscular contractions of the animal will draw the biological liquid 68" (extended semen) into the artificial insemination catheter 56" that has been inserted into the nozzle 40", exerting a partial vacuum within the container 10".

To allow the biological liquid 76" to freely flow out of the first compartment 18", a force (arrow "d" in FIG. 11) can be applied to the sidewall 84*b*" of the conduit section to push the opposing sidewall 84*a*" to move (arrow "e") from a nested position to its original position such that the conduit section 20" is fully open, as shown in FIG. 12.

As in the first embodiment, the collapse of the walls of the container 10" and tearing the scoring 80" to open the sealed section 28", as shown in FIG. 12, releases the vacuum formed inside the container to evacuate the liquid contents 68", 76" from the container.

Figure 13:
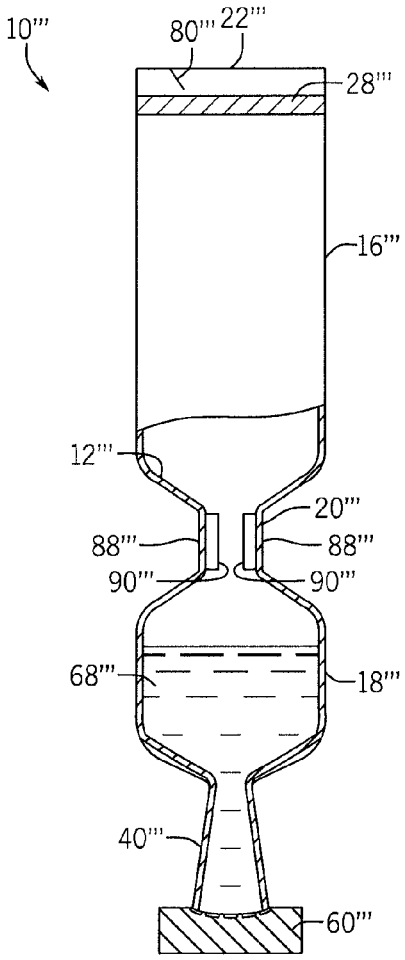
FIGS. 13-14 are partially cut-away views of another embodiment of a multi-compartment container according to the invention.
Figure 14:
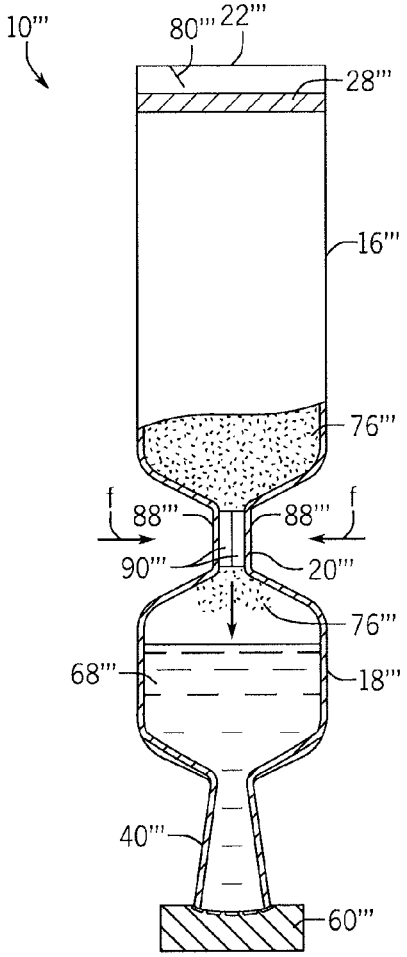
Figure 14A:
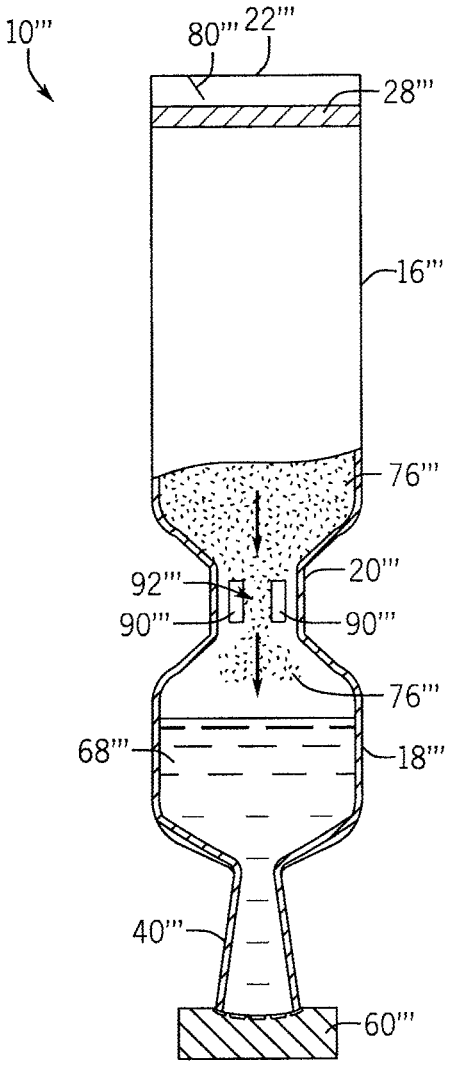
FIG. 14A is a side cutaway view of the container in FIG. 14 showing the adhesive elements in the conduit section.

A third embodiment of a multi-compartment container 10' according to the invention is described with reference to FIGS. 13-14A. As illustrated, the container 10' is constructed with a hollow body of a molded plastic material, first and second compartments 16'", 18'" and a conduit section 20'".

The inner surface 12'" of one or both of the sidewalls 88'" of the conduit section 20'" (shown as both sidewalls) is structured with one or more adhesive elements 90'". As depicted in FIG. 14, upon the application of an external force (arrows "f") onto the sidewalls 84'", the adhesive element(s) 90'" adhere together (or to the sidewall 88') to partially or completely seal the conduit section. As shown in a cross-sectional side view in FIG. 14A, a channel 92'" can be maintained to allow the biological liquid 76'" to pass therethrough, e.g., from the first compartment 16'" to the second compartment 18'".

In embodiments, the adhesive element 90'" is made from a non-spermicidal, biocompatible and water-resistant material that will adhere together or to the sidewall 88" to form a temporary and releasable bond, for example, a wax, glue, gum, pressure-sensitive adhesive, or other highly viscous material, as known and used in the art, that will releasably adhere together by applying pressure. The adhesive material can be applied, for example, by introducing a delivery nozzle into the conduit section 20'" after forming the container 10'" and depositing a small amount of material onto the inner surface 12'" of the conduit section.

In use during an artificial insemination procedure, the sidewalls 88'" can be manually pulled apart to fully open the conduit section 20'" to allow the liquid 76'" to flow out of the first compartment 16'".

Figure 15:
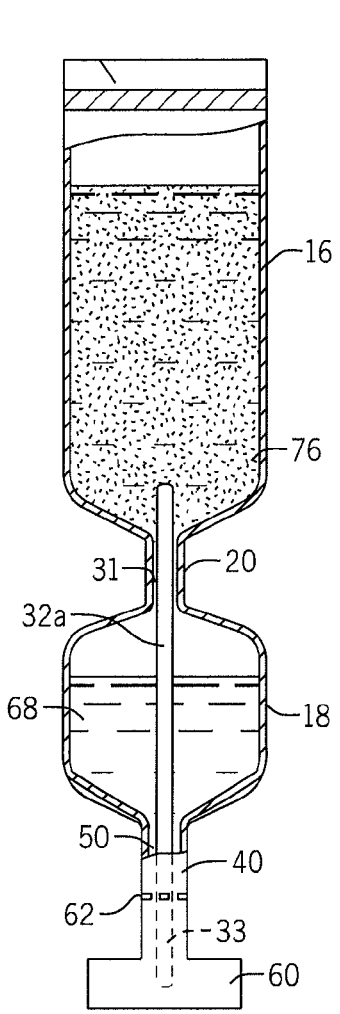
FIG. 15 is a partially cut-away elevational view of another embodiment of a container according to the invention utilizing a rod-like plug to partially or fully seal the channel of the conduit section.
Figure 16:
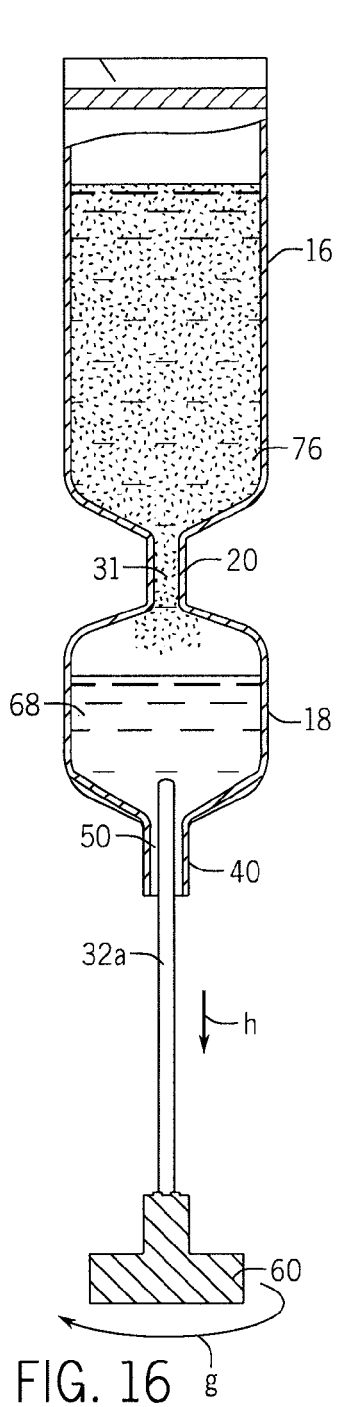
FIG. 16 is a cross-sectional elevational view of the container of FIG. 15 showing the removal of the plug from the container.

In another embodiment of a container illustrated in FIG. 15, container 10 can be structured with a conduit section 20 that is configured to receive a rod-like plug 32*a* through the channel 31 to fully or partially seal the channel 31. In use, the second compartment 18 is filled with fluid 68 (e.g., extended semen) and the rod-like plug 32*a* can be inserted through the channel 31 and the nozzle 40. The end 33 of the plug 32*a* can be inserted into and secured within the severable section 60 (e.g., tab), for example, by thermosealing, ultrasonic welding, etc. In use, the container 10 can be held in a horizontal alignment and, as shown in FIG. 16, the plug 32*a* can be disengaged from the channel 31 by twisting off the severable section 60 (arrow "g") along the score line 62 and withdrawing the plug 32*a*" (arrow "h") from the channel 31 and out of the container. The nozzle 40 can then be connected to a catheter 56 as previously described.

Figure 17:
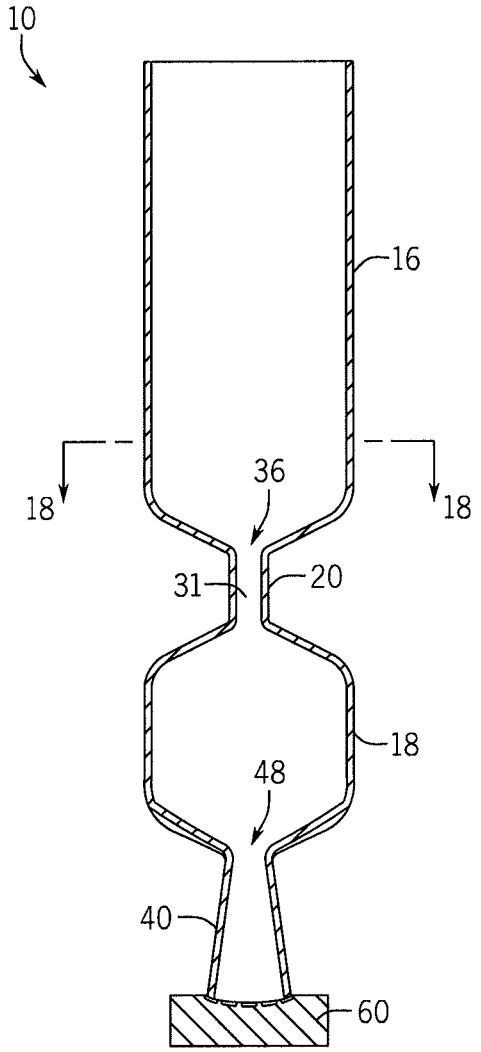
FIG. 17 is a cross-sectional elevational view of another embodiment of a container of the invention structured with a narrow channel through the conduit section that maintains a separation of the fluids in the two compartments without the use of a plug or other sealing element.
Figure 18:
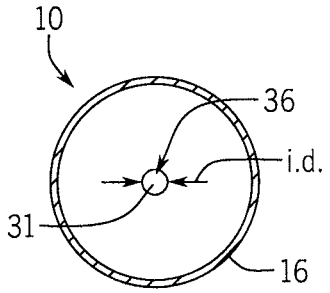
FIG. 18 is a cross-section of the container of FIG. 17, taken along lines 18-18.
Figure 19:
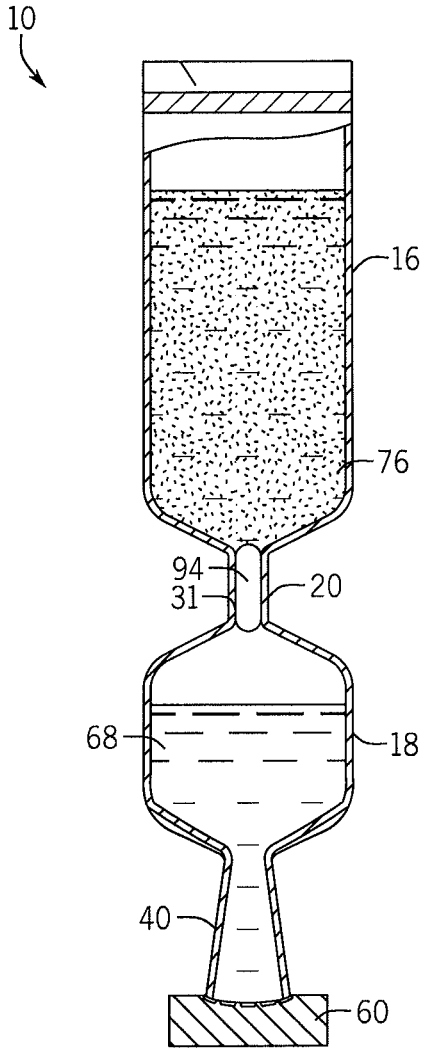
FIG. 19 is a cross-sectional elevational view of the container of FIG. 17 filled with fluids in both compartments.

FIGS. 17-18 illustrate another embodiment of a container 10 which is structured with a conduit section 20 having a channel 31 that maintains a separation of the fluids in the first and second compartments without the use of a plug or other sealing element. The channel 31 is configured with an inner diameter (i.d.) that is sufficiently narrow to maintain the biological fluid 68 (e.g., extended semen) in the second compartment 18 separate from the second biological liquid 76 (e.g., semen extender) in the first compartment 18 by means of surface tension when no compressive force is applied to either compartment, the fluid 68 and the liquid 76 being separated by an air pocket 94 situated within the channel 31, as shown in FIG. 19. In embodiments, the channel 31 has an inner diameter of about 1 mm to about 1.5 mm, and a length of about 10 mm to about 15 mm.

In use, the second compartment 18 can be filled by injecting biological fluid 68 (e.g., extended semen) through a fluid delivery nozzle inserted through the channel 31 (similar to the illustration in FIG. 3). In embodiments, the second compartment 18 can be partially or fully filled with the biological fluid 68, the delivery nozzle withdrawn, and the first compartment 16 then filled with the second biological liquid 76. A meniscus of the two fluids 68, 76 can form at either end of the channel 31 with an air pocket 94 within the channel 31, as illustrated in FIG. 19.

Figure 20:
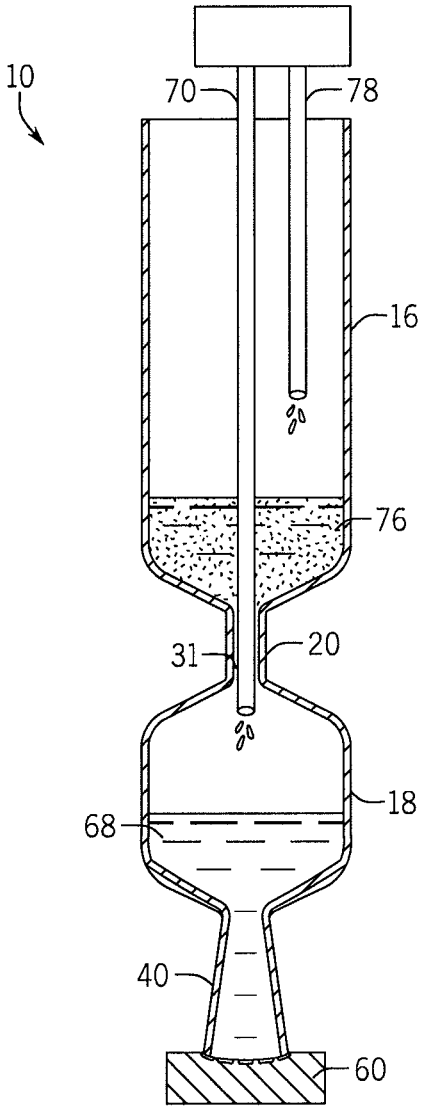
FIG. 20 is a cross-sectional elevational view of the container of FIG. 17 being filled with a two nozzle fluid delivery system.

In other embodiments, as depicted in FIG. 20, the two compartments 16, 18 can be filled simultaneously using a system composed of two delivery nozzles, delivery nozzle 70 which is inserted into the second compartment 18 to deliver the biological fluid 68 (e.g., extended semen) and delivery nozzle 78 which delivers the second biological fluid 76 (e.g., semen extender) into the first compartment 16. Withdrawal of the delivery nozzle 70 from the channel 31 leaves an air pocket (94) which separates the two fluids 68, 76 (similar to the illustration in FIG. 19).

Figure 21:
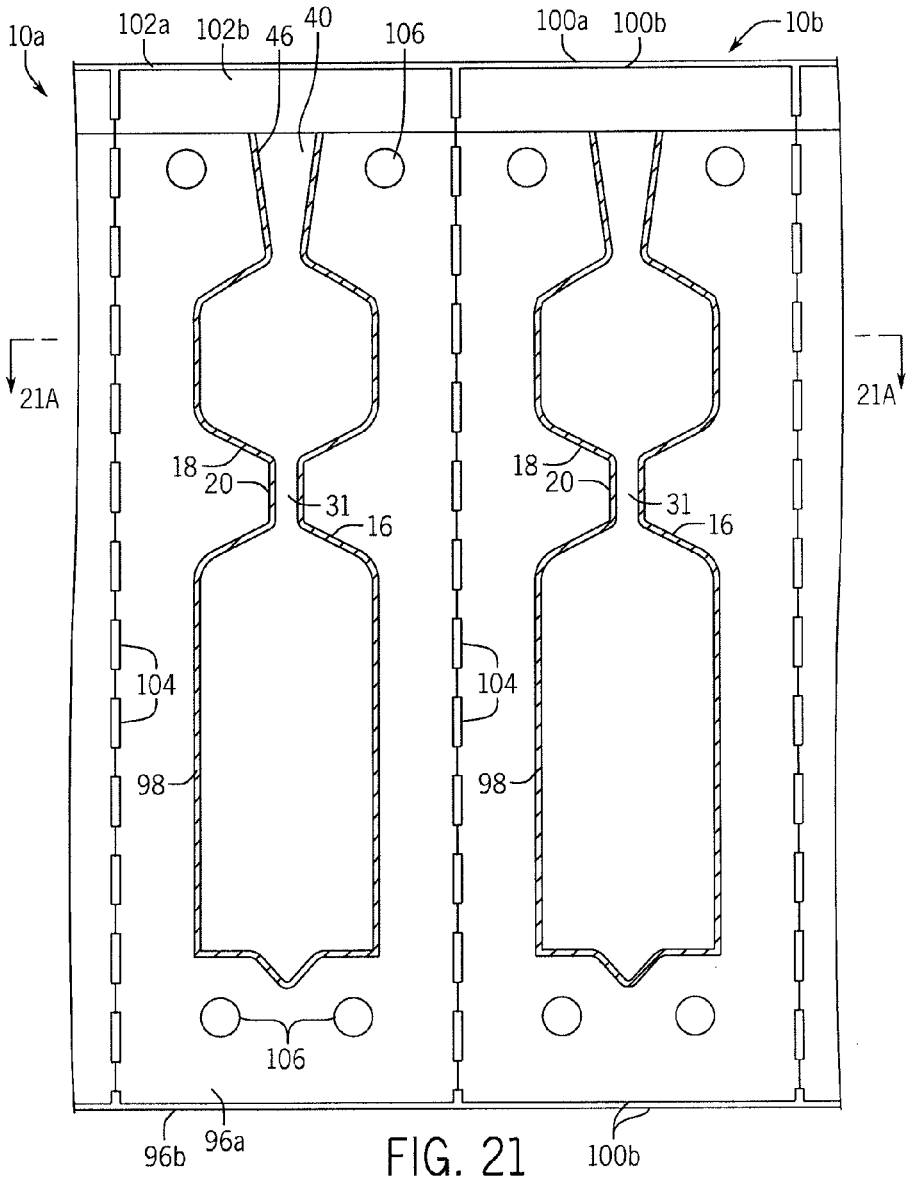
FIG. 21 is a cross-sectional elevational view of another embodiment of a container of the invention formed by sealing plastic sheeting together.
Figure 21A:
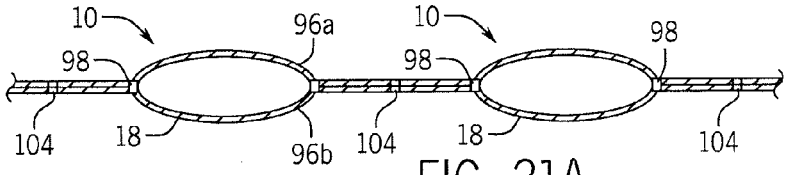
FIG. 21A is a cross-sectional view of the containers shown in FIG. 21, taken along lines 21A-21A.

Referring now to FIGS. 21-21A, in another embodiment, the multi-chambered container can be formed from two flat sheets 96*a*, 96*b* of a flexible, fluid impermeable, biocompatible plastic material that are sealed together, e.g., by heat sealing, in a line 98 to define the perimeter of the body of the containers 10*a*, 10*b*. The edges 100*a*, 100*b* of the two sheets 96*a*, 96*b* along the nozzle 40 are not sealed and form flaps 102*a*, 102*b* with the end 46 of the nozzles 40 accessible between the flaps.

Perforations 104 can be formed through the plastic sheets 96*a*, 96*b* as a line between adjacent containers 10*a*, 10*b* to allow ready separation of the containers. Index holes 106 can also be provided at or near the edges 100*a*, 100*b* of the sheets to facilitate the placement of the sheet of containers on a conveyance mechanism, for example, in conjunction with filling the containers or other processing.

Figure 22:
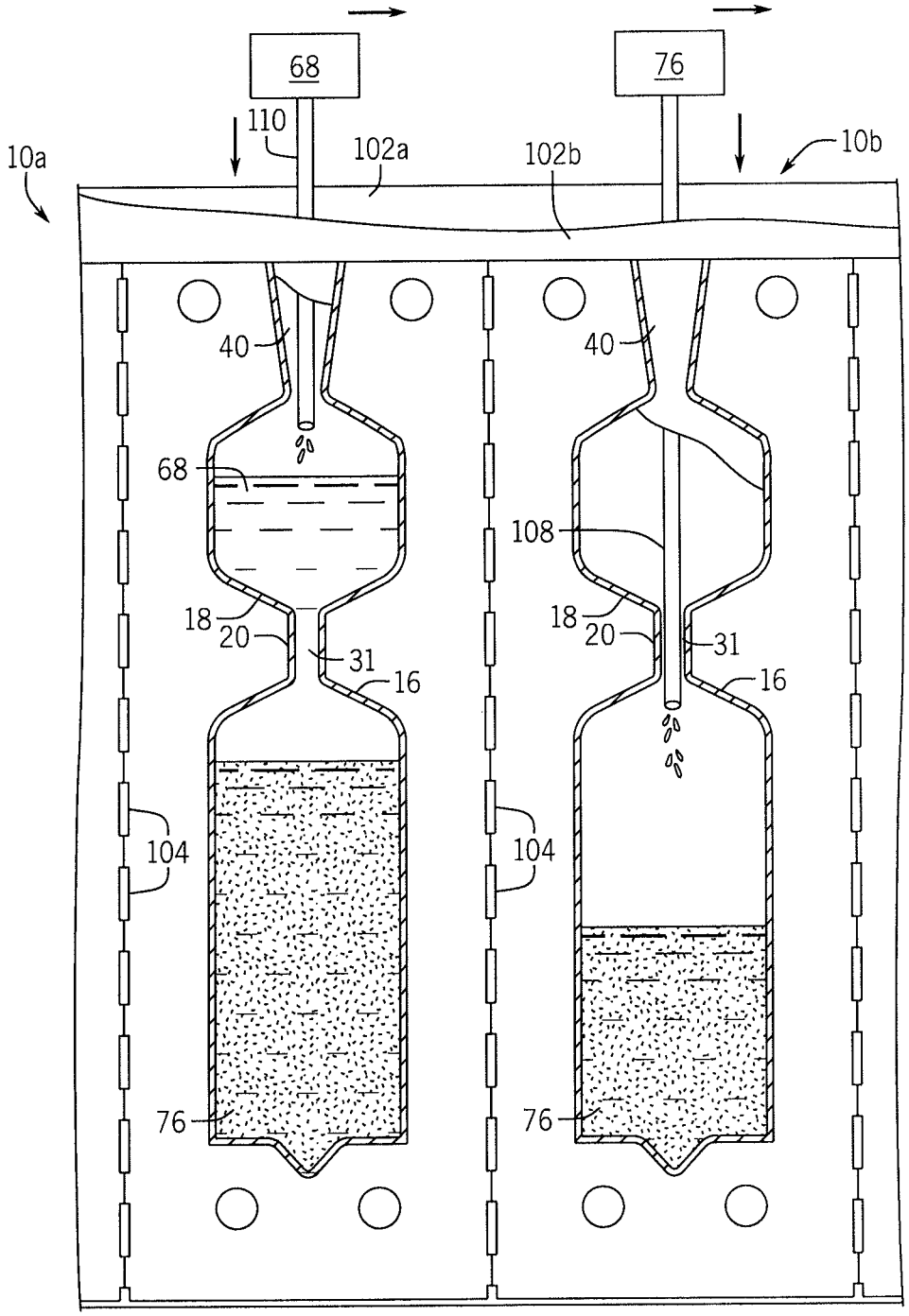
FIG. 22 is a partial cross-sectional view of the containers shown in FIG. 21, showing the filling of the containers.
Figure 23:
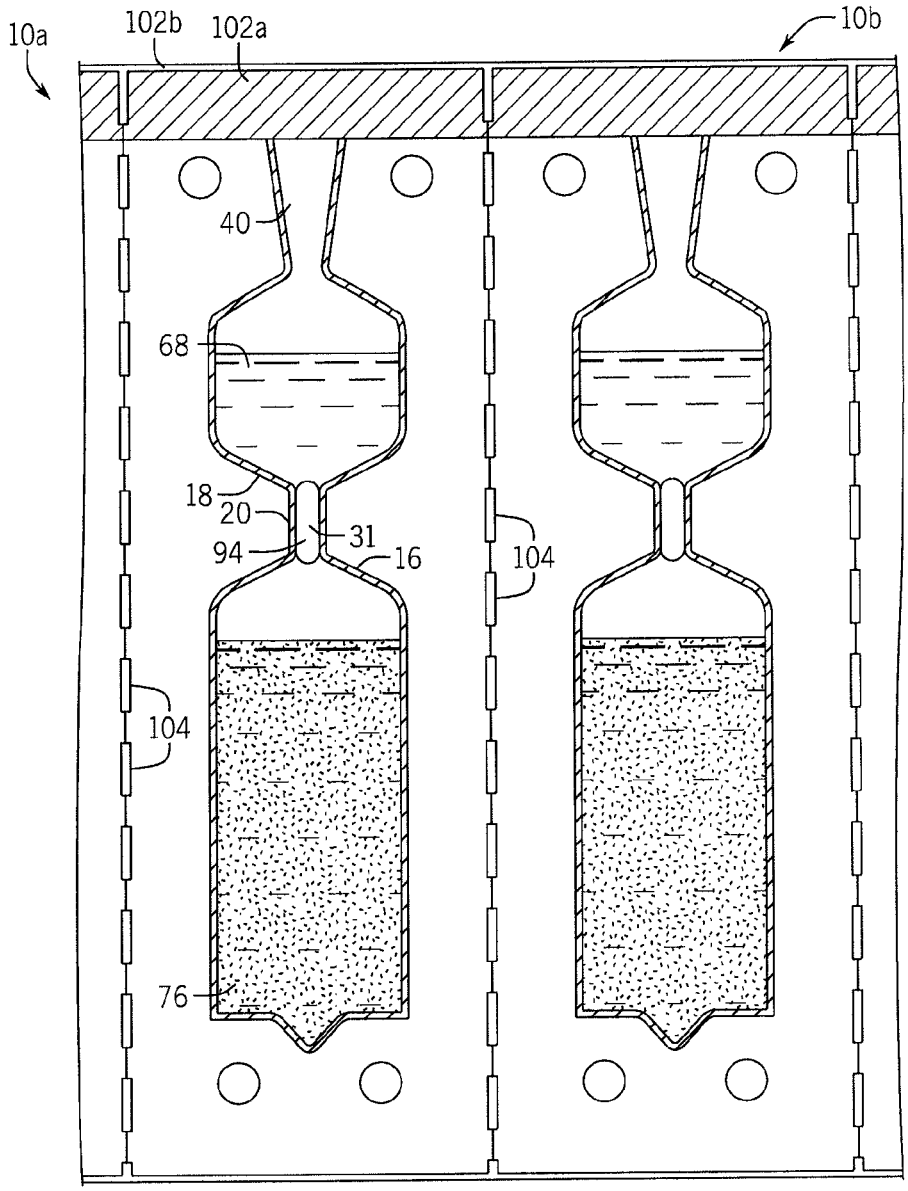
FIG. 23 is a cross-sectional elevational view of the containers shown in FIG. 22, being filled with fluid and sealed.

As illustrated in FIG. 22, the containers 10*a*, 10*b* can be filled using an automated filling system. The second biological fluid 76 (e.g., semen extender) is initially dispensed into the first compartment 16 through a fluid delivery nozzle 108, shown inserted through the channel 31 of the conduit section 20 of container 10*b*. After filling the first compartment 16, the fluid delivery nozzle 108 can be withdrawn and conveyed along and between the flaps 100*a*, 100*b* into the nozzle 40 of the next container. The biological fluid 68 (e.g., extended semen) is then delivered into the second compartment 18 through fluid delivery nozzle 110, shown inserted into the second compartment 18 of the container 10*a*. The fluid delivery nozzle 110 can then be withdrawn and conveyed between the flaps 102*a*, 102*b* and to the nozzle 40 of the next container 10*b*. Upon completion of the filling of the containers 10*a*, 10*b*, the flaps 102*a*, 102*b* (and the openings to the container nozzles 40) can be sealed, e.g., by heat sealing, as illustrated in FIG. 23. In the illustrated embodiment, the containers 10*a*, 10*b* are structured with a channel 31 sized to maintain an air pocket 94 between the fluids 68, 76.

In use, the containers 10*a*, 10*b* can be separated along the perforations 104, the sealed flaps 102*a*, 102*b* opened to expose the opening to the nozzle 40, and an AI catheter (not shown) inserted into the nozzle.

FIGS. 24-28 illustrate another embodiment of a container in which both compartments 16, 18 of the container 10 can be filled at or about the same time (e.g., simultaneously, concurrently) with the desired fluid(s). In an illustrated embodiment shown in FIG. 24, the container 10 can be structured with a conduit section 20 with a channel 31, and the second end (nozzle) 40 of the second compartment 18 configured with a severable section 60 (e.g., tab or flange) that can be manually twisted off along a score line 62 to open the end 46 of the nozzle 40.

The channel 31 of the conduit section 20 is configured with a small inside diameter (i.d.) that maintains air therein to separate the fluids in the first and second compartments, and allows for insertion therethrough of a rod-like tube 112 for fluid delivery and to fully or partially seal the channel 31. The severable section 60 includes an opening or channel 114 which is sized to receive the rod-like tube 112 therethrough to fully or partially seal the opening 114 but allow the tube 112 to be advanced into the second compartment 18 and through the channel 31 of the conduit section 20.

Figure 24:
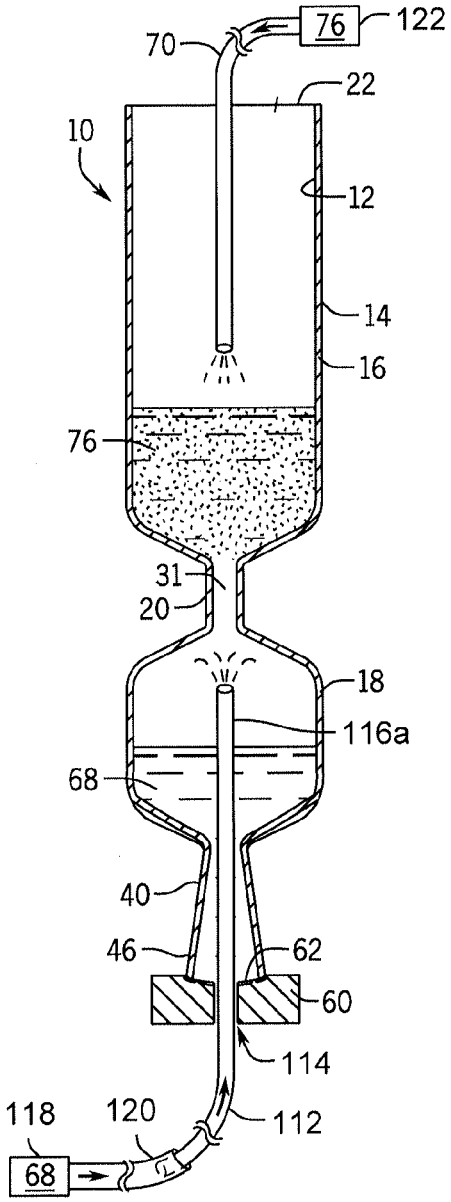
FIG. 24 is a cross-sectional elevational view of an embodiment of a container of the invention for simultaneous filling of both compartments.
Figure 25:
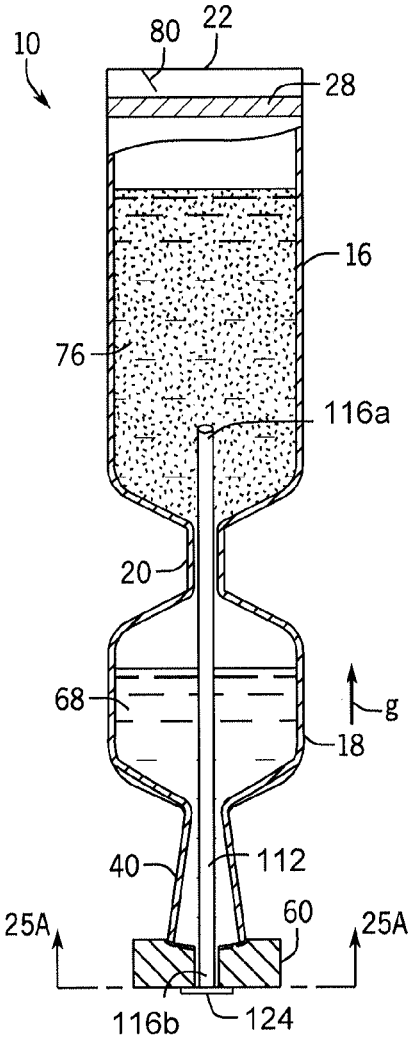
FIG. 25 is a cross-sectional view of the container shown in FIG. 24 showing the rod-like tube positioned and sealed in the container.
Figure 25A:
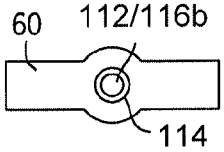
FIG. 25A is a plan view of the severable section of the container shown in FIG. 25, taken along lines 25A-25A.

The rod-like tube 112 is a hollow tube or straw with first and second open ends 116*a,b*, to allow passage of fluid 68 therethrough for delivery into the chamber of the second compartment 18. In embodiments, the rod-like tube 112 is constructed of a rigid to semi-rigid plastic to facilitate being advanced through the opening 114 in the severable section (e.g. tab) 60 and inserted through the channel 31 of the conduit section 20. In embodiments, the rod-like tube 112 can be cut from a length of tubing after placement in the container (as shown in FIGS. 24-25) or can be pre-cut to a desired length and inserted into the container.

To fill the container 10, the first end 116*a* of the rod-like tube 112 is inserted through the opening 114 of the severable section (e.g., tab) 60 and positioned within the chamber of the second compartment 18. The rod-like tube 112 is connected to a source 118 for fluid 68, for example, by means of a tubing 120. A filling device 70 such as a cannula, delivery nozzle or an automatic filler, connected to a source 122 for fluid 76, can be introduced into the open end 22 of the container 10 for filling the first compartment 16.

The first and second compartments 16, 18 can then be filled with fluid 68, 76, respectively. During filling, air being displaced from the second compartment 18 can bubble up through the fluid 76 in the first compartment 16. During filling, air remains within the channel 31 to maintain separation of the fluids 68, 76. Upon filling the first and second compartments 16, 18, the flow of fluids 68, 76 is terminated and the rod-like tube 112 is advanced (arrow "g") further into the chamber of the second compartment 18 and through the channel 31, as depicted in FIG. 25. The second end 116*b* of the rod-like tube 112 can then be cut (if not pre-cut) and sealed, for example, by thermosealing, ultrasonic welding, etc., to form a seal 114 over the end 116*b* and the opening 114 of the severable section (e.g., tab) 60. The filling device 70 is also withdrawn and the first end 22 of the first compartment 16 can be sealed along a sealing section 28 by heat sealing, ultrasound, infrared, etc.

Figure 26:
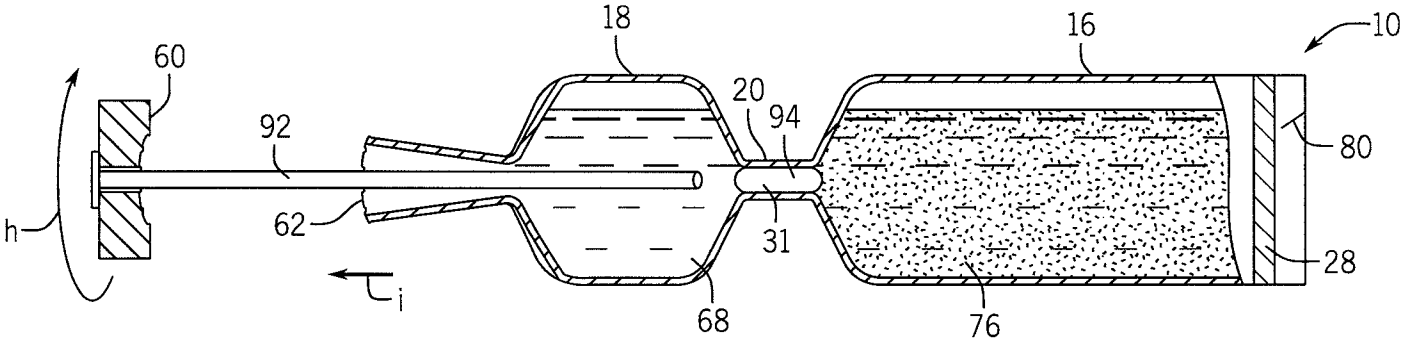
FIG. 26 is a cross-sectional view of the container shown in FIG. 25 in use, with the tab and the rod-like tube being removed.
Figure 27:
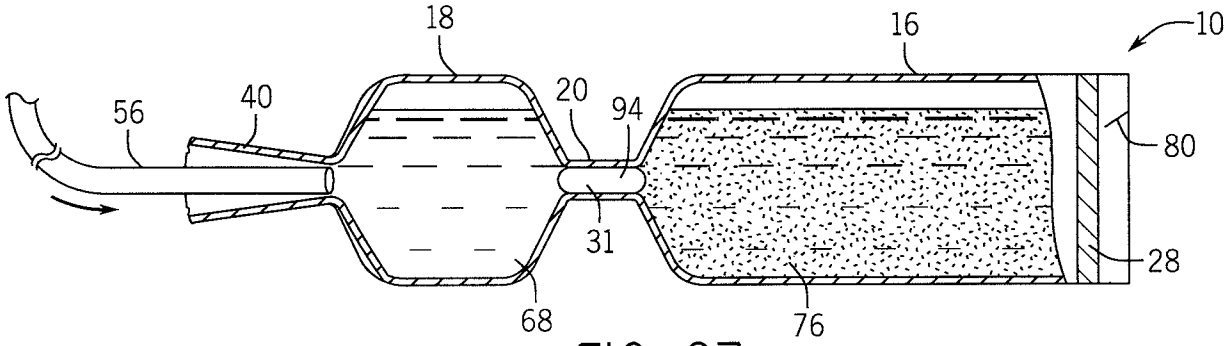
FIG. 27 is a cross-sectional view of the container shown in FIG. 26, in a subsequent step with a catheter inserted in the nozzle end of the container.
Figure 28:
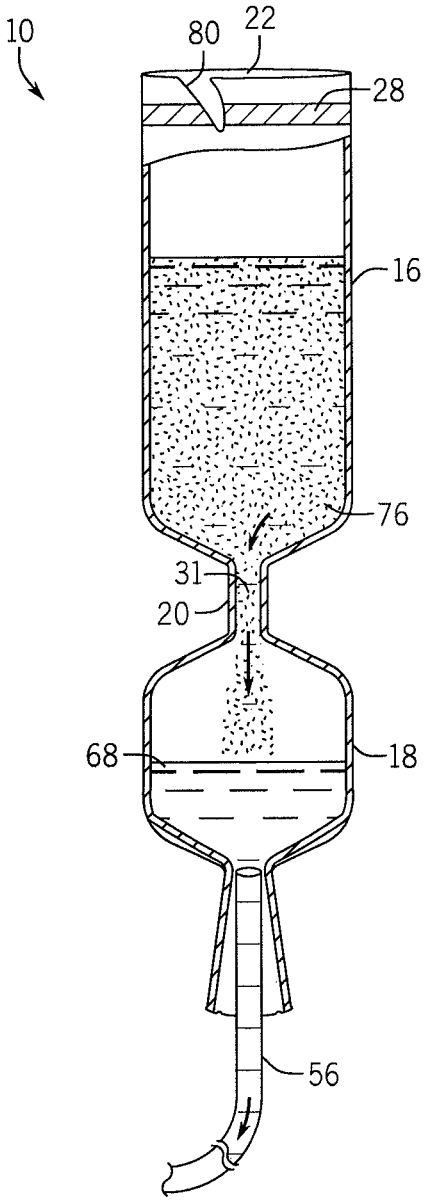
FIG. 28 is a cross-sectional view of the container shown in FIG. 27, in a subsequent step, showing the liquids being dispensed from the container.

Referring now to FIG. 26, in use, the container 10 can be held horizontally and the severable section 60 twisted off (arrow "h") along the score line 62, and the rod-like tube 112 withdrawn (arrow "i") from the channel 31 and removed from the container 10. An insemination catheter 56, which has been inserted into the animal's body, can then be seated in the nozzle 40 of the container, as depicted in FIG. 27. As shown in FIG. 28, the fluid 68, 76 within the first and second compartments 16, 18 is drawn into the catheter 56 during the artificial insemination procedure, and the score line 80 can be torn to open the sealed section 28 to release the vacuum that can form inside of the container 10. Pressure can be applied to the fluid 76 in the first compartment 16 to force the fluid through the channel 31 into the second compartment 18 and into the catheter 56.

EXAMPLE

The invention provides multi-compartment containers for low dose insemination that maintain lower dose volumes with high motility and cell viability in one compartment and a necessary physiological volume for insemination in a second compartment. To optimize results and ensure successful fertilization with low dose volumes, an extender is utilized that prevents dilution shock and allows storage in a lower concentration of sperm cells per ml.

The semen can be packaged in a dual-stage tube according to the invention, which is optimized for low dose semen delivery. The low volume dose is combined with additional transport medium to facilitate peristaltic movement of the uterus to transport the semen cells to the site of fertilization. The dual-stage containers of the invention conveniently package a low volume of extended semen in a preservation medium ("PM fluid") and a separate volume of an activation medium ("AM fluid") in a single tube/container.

The dual-stage low dose semen tubes of the invention store the necessary volume of media in one convenient easy to use package, and are designed to optimize low dose IUI. For example, an about 20-ml reservoir compartment can be used for low dose/low concentrated semen volumes down to about 500 million sperm cells/dose, and a 50-ml reservoir compartment for sperm cell activation and reconstitution medium. The two-compartment containers maintain a uniform temperature of both packaged extenders. A removable or dislodgeable sealing element separates the low dose semen volume from the activation and reconstitution medium until insemination.

A sow can be inseminated utilizing the SafeBlue Clear glide IUI insemination catheter in combination with a dual-stage container of the invention, for gentle insertion and deep intrauterine semen delivery. The inner catheter's smoothly rounded tip is designed to easily glide through the cervix. With fewer sperm cells per dose, the semen is advantageously delivered beyond the cervix via intra-uterine insemination in a hygienic manner.

A two-stage extender system, AndroPRO IUI™ PM/AM (available commercially from Minitube of America, Verona, Wis.), can be used to protect and preserve sperm cells from the negative effects of low dose concentrations during storage and then to activate sperm cells for optimal fertilization just prior to insemination. The first stage, PM, is formulated with an additive to preserve sperm cell concentrations as low as 500 million per dose. The second stage, AM, is formulated to provide two functions: activation of the sperm cells from storage and to provide an adequate volume of medium to support the peristaltic motion of the uterus, which transport the semen to the site of fertilization.

In applications, the AndroPRO IUI™ PM extender is combined with the sperm cells to maintain and stabilize sperm cell motility at low dose concentrations. To successfully reach the oviduct during IUI, the low volume, low concentration dose is combined with a larger volume of medium, such as the AndroPRO IUI™ AM extender, to add the necessary volume to produce the physiological conditions needed to transport sperm cells to the site of fertilization. An extender such as the AndroPRO IUI™ AM extender is formulated with additives to boost sperm cell activity and stimulate an increase in progressive motility, e.g., an increase in progressive motility at low dose concentrations stored up to five days.

A low concentration of sperm cells in a high volume dose can adversely affect semen shelf life. The PM extender, such as the AndroPRO IUI™ PM extender, is formulated to maintain the sperm cells at low metabolism (at "rest") and can include an additive such as the Cell Shield Plus (CSP) extender additive (available commercially from Minitube of America, Verona, Wis.) to enhance the effect of the extender to protect low dose sperm motility and viability from the effects of dilution, and increase the ability of sperm cells to tolerate stressors associated with semen preservation and transport such as temperature fluctuations (e.g., between 10° C. to 25° C.), low dose concentrations, cold storage and oxidative stressors.

It is specifically intended that the present invention not be limited to the embodiments and illustrations contained herein, but include modified forms of those embodiments including portions of the embodiments and combinations of elements of different embodiments as come within the scope of the following claims.

What is claimed:

1. A container comprising an inner surface and an outer surface, a first compartment connected by a conduit section to a second compartment, and an unattached and movable closure element situated within the first compartment, the second compartment or within a channel extending through the conduit section;

the first compartment having a first end being sealable and a second end integrally molded to one end of the conduit section, and at least one protuberance on the inner surface proximal to the conduit section and configured to prevent the closure element from sealing the opening to the channel of the conduit section; and the second compartment having a first end integrally molded to an opposing end of the conduit section and a second end comprising a nozzle, and at least one protrusion on the inner surface proximal to the nozzle and configured to block entry of the closure element into the nozzle;

wherein the channel is sized to receive the closure element therein to at least partially close the channel, and the closure element is dislodgeable from the conduit section into the second compartment to allow fluid within the first compartment to flow into the second compartment.

2. The container of claim 1, having a hollow body of a molded plastic material.

3. The container of claim 1, comprising two plastic sheets sealed together to define the first and second compartments and the conduit section of the container.

4. The container of claim 1, wherein the second end of the second compartment comprises an opening, and said opening of the second end and the channel of the conduit section are sized for receiving a tube therethrough.

5. The container of claim 1, wherein the channel of the conduit section is sized to retain the closure element therein to partially close the channel.

6. The container of claim 1, wherein the channel of the conduit section is sized to retain the closure element therein to fully seal the channel.

7. The container of claim 1, further comprising at least one support element spaced apart from and situated alongside the conduit section with opposing ends of the support element connected to the outer surface of the first and the second compartments.

8. The container of claim 1, wherein the nozzle proximal to the second compartment is sized for seating an end of a catheter therein.

9. The container of claim 1, wherein the nozzle terminates in an end having a diameter greater an inner diameter of the nozzle proximal to the second compartment.

10. The container of claim 1, wherein the nozzle defines a plurality of accordion folds, corrugations or a combination thereof.

11. The container of claim 1, wherein the nozzle terminates in an end having a severable tab extending therefrom.

12. The container of claim 11, wherein the severable tab comprises an opening extending therethrough to the second compartment, and the opening through the severable tab and the channel of the conduit section are configured to receive a tube for fluid delivery therethrough such that the tube can be advanced through the opening in the tab into the second compartment and into the channel of the conduit to fully or partially seal the channel.

13. The container of claim 1, further comprising a biological liquid within each of the first compartment and the second compartment.

14. The container of claim 13, wherein the biological liquid within one of the first and second compartments comprises extended semen, and the biological liquid within the other of the first and second compartments comprises a fluid without sperm cells.

15. The container of claim 14, wherein the biological liquid without sperm cells is a fluid selected from the group consisting of a semen extender, nutrient solution, stimulant solution and pH buffer solution.

16. The container of claim 14, wherein the biological liquid comprising the extended semen comprises 500 million to 3 billion sperm cells in 15 to 20 mls semen extender, and the biological liquid comprising the fluid without sperm cells comprises 30 to 50 mls semen extender without sperm cells, with a total combined volume of liquid of 50-70 mls.

17. The container of claim 13, wherein the closure element is situated within the channel of the conduit section whereby of the biological liquid is passable through said conduit section between the first compartment and the second compartment.

18. The container of claim 1, wherein the closure element is a plug.

19. The container of claim 18, wherein the plug is spherical-shaped.

20. The container of claim 1, wherein the closure element comprises a wax, a gel, glass, metal, plastic, or thermoplastic elastomer.

21. The container of claim 1, wherein the closure element is porous or semi-permeable to liquid.

22. The container of claim 1, wherein at least one of the protuberance within the first compartment and the protrusion within the second compartment comprises one or more ribs.

23. A container comprising an inner surface and an outer surface, a first compartment connected by a conduit section to a second compartment, and an unattached and movable spherical mass situated within the first compartment, the second compartment or within a channel extending through the conduit section;

the first compartment having a first end and a second end, the first end being sealable and the second end connected to one end of the conduit section, and at least one protuberance on the inner surface proximal to the conduit section and configured to prevent the spherical mass from sealing the opening to the channel of the conduit section; and the second compartment having a first end and a second end, the first end connected to an opposing end of the conduit section, the second end with a nozzle having an inner diameter and a closed end, and at least one protrusion on the inner surface proximal to the nozzle and configured to block entry of the spherical mass into the nozzle;

wherein the channel is sized to receive the spherical mass therein to at least partially close the channel.

24. The container of claim 23, wherein the spherical mass comprises a wax, a gel, glass, metal, plastic, or thermoplastic elastomer.

25. The container of claim 23, wherein at least one of the protuberance within the first compartment and the protrusion within the second compartment comprises one or more ribs.

26. The container of claim 23, further comprising a biological liquid within the first compartment and the second compartment, and the spherical mass situated within the channel of the conduit section whereby the biological liquid is passable through said conduit section from the first compartment to the second compartment.

27. The container of claim 23, further comprising a biological liquid within each of the first compartment and the second compartment.

28. The container of claim 27, wherein the biological liquid in one of the first or the second compartments comprises extended semen, and the biological liquid in the other of the first or second compartments comprises a liquid without sperm cells.

29. The container of claim 28, wherein the biological liquid without sperm cells is a fluid selected from the group consisting of a semen extender, nutrient solution, stimulant solution and pH buffer solution.

30. A method of delivering a biological fluid to an animal using a container, the container comprising a first compartment connected by a conduit section to a second compartment, and a biological fluid situated within the first compartment and the second compartment;

the first compartment of the container having a first end being sealable and a second end connected to one end of the conduit section, the second compartment having a first end connected to an opposing end of the conduit section and a second end comprising a nozzle, and the conduit section having a channel extending therethrough, wherein the conduit section is structured to at least partially close the channel without a closure element or with a dislodgeable or removable element situated therein, such that the fluid within the first compartment can be maintained substantially separate from the fluid within the second compartment;

the method comprising:

opening the closed end of the nozzle of the container;

seating an insemination catheter into the nozzle of the container, the insemination catheter being inserted into a female animal to be inseminated; and discharging the biological fluids from the first and second compartments through the nozzle into the insemination catheter.

31. The method of claim 30, wherein the container comprises a biological liquid comprising extended semen in one of the first or the second compartments, and a biological liquid without sperm cells in the other of the first or second compartments.

32. The method of claim 30, wherein the container comprises a spherical mass situated within the channel of the conduit section, and discharging the biological fluids comprises squeezing sides of the first compartment to dislodge the spherical mass from the channel of the conduit section into the second compartment.

* * * * *